US008351841B2

(12) United States Patent
Kawaguchi

(10) Patent No.: US 8,351,841 B2
(45) Date of Patent: Jan. 8, 2013

(54) IMAGE PROCESSING APPARATUS

(75) Inventor: Daisuke Kawaguchi, Abiko (JP)

(73) Assignee: Canon Kabushiki Kaisha (JP)

( * ) Notice: Subject to any disclaimer, the term of this patent is extended or adjusted under 35 U.S.C. 154(b) by 889 days.

(21) Appl. No.: 12/179,266

(22) Filed: Jul. 24, 2008

(65) Prior Publication Data

US 2009/0026684 A1 Jan. 29, 2009

(30) Foreign Application Priority Data

Jul. 24, 2007 (JP) ..... 2007-191597

(51) Int. Cl.
*G03G 15/00* (2006.01)
*B41J 11/00* (2006.01)

(52) U.S. Cl. ..... 399/388; 399/395; 400/579

(58) Field of Classification Search ..... 399/395, 399/388; 271/227, 228; 400/579
See application file for complete search history.

(56) References Cited

U.S. PATENT DOCUMENTS 6,059,285 A * 5/2000 Suga et al. ..... 271/228
2002/0017755 A1* 2/2002 Dobberstein et al. ..... 271/227
2007/0059000 A1* 3/2007 Shibuya ..... 399/44

FOREIGN PATENT DOCUMENTS

JP 8-108955 A 4/1996
JP 10-175752 A 6/1998

* cited by examiner

*Primary Examiner* — Judy Nguyen
*Assistant Examiner* — Blake A Tankersley
(74) *Attorney, Agent, or Firm* — Rossi, Kimms & McDowell LLP

(57) ABSTRACT

The present invention prevents a conveying force of a rotation body from being locally deteriorated, and increases lifetime of the rotation body. A printer 1000 changes, by means of control of a controller, starting position at which rotation speeds of skew feeding correcting drive rollers 21*a* and 22*a* are changed. With this, the printer 1000 prevents a conveying force from being concentrated on specific positions of the skew feeding correcting drive rollers 21*a* and 22*a*, thereby preventing local wearing and deterioration of the conveying force, and the skew feeding correcting drive rollers 21*a* and 22*a* can be used for a long term.

6 Claims, 24 Drawing Sheets

RELEASE t = t1

NIP t = t2

FIRST SKEW FEEDING CORRECTING DECELERATION t = t3 (= t1 + TA)

FIRST SKEW FEEDING CORRECTING ACCELERATION t = t4

SECOND SKEW FEEDING CORRECTING DECELERATION t = t6

SECOND SKEW FEEDING CORRECTING ACCELERATION t = t7

RELEASE t = tg

AFTER CHANGE OF TA

NIP t = t10

ACCELERATION (DECELERATION)
START t = t12

DECELERATION (ACCELERATION)
START t = t11

RELEASE t = t13

IMAGE PROCESSING APPARATUS

BACKGROUND OF THE INVENTION

1. Field of the Invention

The present invention relates to an image processing apparatus which forms an image on a conveyed sheet or reads an image of a conveyed original.

2. Description of Related Art

A conventional image forming apparatus which forms an image on a sheet such as a copying machine and a printer and a facsimile machine and a conventional image reading apparatus which reads an image of an original such as a scanner include a sheet conveying apparatus which conveys a sheet or an original.

In the case of the sheet conveying apparatus of the image processing apparatus such as the image forming apparatus and the image reading apparatus and it is necessary to straightly send a sheet or an original to the image forming portion of the image forming apparatus or the image reading portion of the image reading apparatus. If the sheet conveying apparatus obliquely sends a sheet to the image forming portion, the image forming apparatus obliquely forms an image on the sheet. If the sheet conveying apparatus obliquely sends an original to the image reading portion, the image reading portion obliquely reads the original. Thus, the sheet conveying apparatus includes a registration apparatus which registers the skew feeding before an inclined (skew fed) sheet or original is sent to the image forming portion or the image reading portion.

As systems of the registration apparatus, there are a loop registration system and a shutter registration system. According to the loop registration system, a tip end of a sheet is butted against a nip of a pair of stopped rollers to form the sheet with a warp and the skew feeding of the sheet is registered utilizing rigidity of the sheet. According to the shutter registration system, a tip end of a sheet is butted against a shutter member provided in a sheet conveying passage and then, the shutter member is retracted from the sheet conveying passage.

In recent years, however, with the digitization of the image forming apparatus and the image reading apparatus, there is a tendency that a distance between sheets or originals ("sheet-gap", hereinafter) is reduced. The reason why the sheet-gap is reduced is that more sheets can be processed within a short time and substantial image forming speed can be enhanced without increasing the processing speed of image formation, and that more originals can be read within a short time without increasing the reading speed of originals.

Therefore, time required for registration is one of the factors which determine the sheet-gap. As one of methods for shortening the time required for registration and there is an active registration method in which skew feeding of sheets is corrected while conveying sheets. According to this method, a tip end of a conveyed sheet is detected by two sensors disposed in a sheet conveying passage in a direction intersecting with a sheet conveying direction, and when the sheet is skew fed, a control portion calculates the inclination of the tip end of the sheet based on a difference in detection time. Then, a sheet conveying speed of a plurality of skew feeding correction rollers which are disposed in a direction intersecting with the sheet conveying direction and which rotates independently are controlled on the calculated skew feeding amount and the sheet is turned to correct the skew feeding (see Japanese patent Application Laid-open No.H8-108955).

According to this active registration method, since the skew feeding can be corrected while conveying a sheet, reduce the sheet-gap as compared with the loop registration method and the shutter registration method in which a sheet is once stopped.

A sheet conveying apparatus in which the active registration method is employed will be described based on FIG. 24. A sheet conveying apparatus 900 includes a tip end detection sensor 904 which detects a tip end of a sheet, a pair of conveying rollers 905 and 906, skew feeding detection sensors 913 and 914 which detect skew feeding of a sheet, and a pair of registration rollers 907 and 908 which correct the skew feeding of a sheet. The pair of conveying rollers 905 and 906 includes a drive rollers 905*a* and 906*a* which are rotated by a motor 910 and which have half-moon shaped cross sections, and follower rollers 905*b* and 906*b* which follow the drive rollers 905*a* and 906*a*.

If the tip end detection sensor 904 detects the tip end of a sheet, the drive rollers 905*a* and 906*a* rotate by predetermined number of times and sends a sheet into the pair of registration rollers 907 and then, the drive rollers 905*a* and 906*a* stop at a position where nip between the follower rollers 905*b* and 906*b* is released. At that time, the drive rollers 905*a* and 906*a* rotate in a state where the directions of the half-moon shapes match with each other (the same phases).

Each of the pair of registration rollers 907 and 908 comprises a pair of rollers which independently rotate in a direction intersecting with the sheet conveying direction. The pair of registration rollers 907 and 908 turn a sheet such that sheet conveying speeds of the pair of rollers disposed in the direction intersecting with the sheet conveying direction are different from each other, and correct the skew feeding of the sheet with the skew feeding amount detected and calculated by the skew feeding detection sensors 913 and 914. The nip of the pair of conveying rollers 905 and 906 of the sheet which is turned by the pair of registration rollers 907 and 908 and whose skew feeding is corrected is released. Therefore, no load is added from the pair of conveying rollers 905 and 906, the skew feeding is corrected smoothly.

With this, the sheet conveying apparatus 900 can continuously convey a sheet while maintaining the correcting precision of the skew feeding at high level without restraining a rear end side of the sheet by the pair of conveying rollers 905 and 906. The structure of the sheet conveying apparatus 900 can also be applied to an image reading apparatus which convey an original.

As described above, correction of the skew feeding of a sheet is extremely important to enhance the forming precision of an image or the reading precision of an image of the image forming apparatus or the image reading apparatus. In the case of the active registration method using the skew feeding correcting rollers which are coaxially disposed and independently rotate, the skew feeding correcting precision is deteriorated depending upon a machining error of the skew feeding correcting rollers in some cases.

The reason is as follows. That is, in the case of the two pairs of skew feeding correcting rollers having machining errors, even if the rollers rotate at isogonal speed, since a circumferential speed of the roller is irregularly varied in the nip portion, the skew feeding correcting rollers irregularly convey a sheet in a meandering manner. Even if the skew feeding amount of a nipped sheet is 0, if the skew feeding correcting rollers pass the sheet to a downstream pair of conveying rollers in a state where the sheet is conveyed in the meandering manner, there is a fear that the skew feeding correcting rollers pass the sheet in the skew feeding state. As a result the skew feeding correcting precision of a sheet of the sheet conveying apparatus 900 is deteriorated.

To solve this problem, it is conceived that all of the skew feeding correcting rollers always maintain positions thereof on their outer peripheries where the rollers start coming into contact with a sheet at the same level (phases of the pair of registration rollers are aligned with each other), thereby preventing the skew feeding correcting precision from being deteriorated. That is, if the meandering states of sheets conveyed by the skew feeding correcting rollers are brought into exact agreement every time, the variation of the skew feeding amount is reduced. If the fact that a constant amount of skew feeding is generated in a sheet is previously found, reduce the amount of skew feeding by carrying out the skew feeding correcting control in which the control amount is corrected correspondingly.

The skew feeding correcting precision of a sheet is pertinent to a conveying load of a sheet and a conveying force of the skew feeding correcting rollers. It is necessary to always satisfy the relation of a conveying load of a sheet<a conveying force of the skew feeding correcting rollers.

If the relation of a conveying load of a sheet>a conveying force of the skew feeding correcting rollers, it is impossible to correct the skew feeding. Even if the conveying load of a sheet and the skew feeding correcting rollers are close to each other, a slip is generated between the sheet and the skew feeding correcting rollers, and the skew feeding can not be corrected sufficiently.

The conveying load of a sheet is mainly generated when the sheet slides on a conveying path. Thus, the conveying load of a sheet can be reduced to some degree if the sheet can easily slide on a conveying path where skew feeding of sheet is corrected.

In the case of the sheet conveying apparatus of the active registration system, a conveying load of a sheet is reduced. Thus, there is proposed a sheet conveying apparatus in which an upstream conveying roller of the skew feeding correcting roller is configured such that it can move in a direction intersecting with the sheet conveying direction, it follows the turning motion when the skew feeding of a sheet is corrected and a load at the time of turning is reduced (see Japanese patent Application Laid-open No. H10-175752).

In the conventional sheet conveying apparatus, an upstream side of the skew feeding correcting roller is formed into a shape or structure in which a conveying load is small. However, since a conveying load applied to the skew feeding correcting roller can not be 0, a slip may be produced between the skew feeding correcting roller and a sheet in some cases. Further, when a sheet is turned by a speed difference between the skew feeding correcting rollers, since the sheet is turned in the roller nip, a slip is generated between the skew feeding correcting roller and the sheet in a rotation direction of the sheet. Since an inertial force of a sheet is applied to the slip phenomenon generated between the skew feeding correcting roller and the sheet, the slip phenomenon appears most seriously at an instant when a turning acceleration is applied to the sheet.

When control is performed (phase control) such that all of the skew feeding correcting rollers always maintain positions thereof on their outer peripheries where the rollers start coming into contact with a sheet at the same level, slip phenomena are concentrated on the same position on the outer periphery of the skew feeding correcting roller. Therefore, there is a problem that the same portions on the outer peripheries of the skew feeding correcting rollers are worn, a conveying force of a sheet is largely deteriorated at the worn portion, and a conveying amount of a sheet is reduced, and the skew feeding correcting precision is deteriorated. This problem is not limited to the skew feeding correcting roller, and the same problem is also generated when the conveying roller which conveys sheets in the sheet conveying direction while accelerating or decelerating the sheets is controlled in phase.

Hence, in a conventional sheet conveying apparatus having the conventional skew feeding correcting rollers or conveying rollers whose phases are controlled, the rollers are exchanged periodically in accordance with reduction in conveying force of the skew feeding correcting rollers or conveying rollers to maintain the sheet conveying precision such as the skew feeding correcting precision. However, if the rollers are exchanged periodically, cost is increased.

The image forming apparatus having the sheet conveying apparatus of the active registration system is a high speed machine in which the number of images to be formed per unit time is high in many cases, and the image forming apparatus is used commercially in many cases. Thus, if the stop time required for maintenance in which the skew feeding correcting rollers or conveying rollers are exchanged is long, this deteriorates the image forming efficiency.

In recent years, sheets to be used are diversified from thin sheet to thick sheet from small size of about postcard size to large size of about 330 mm×488 mm, and image forming apparatuses which cope with the diversification are increased. Thus, in the case of the sheet conveying apparatus, the skew feeding correcting roller is prone to be worn locally when a thick sheet or large size sheet is conveyed, the conveying force is reduced, the number of exchanging operations of the skew feeding correcting rollers or conveying rollers is increased, and a serviceability ratio is deteriorated.

As described above, it is required that lifetime of a rotation body such as the skew feeding correcting roller and the conveying roller whose phase is to be control is increased.

The present invention prevents a sheet conveying force of a rotation body such as a skew feeding correcting roller and a conveying roller from being reduced locally, reduces the deterioration in the skew feeding correcting precision, and increases the lifetime of the rotation body.

SUMMARY OF THE INVENTION

An image processing apparatus of the present invention comprises an image processing portion which processes an image on a sheet; a rotation body which conveys a sheet toward the image processing portion; and a control portion which starts rotation of the rotation body from the same position in a circumferential direction and which changes a rotation speed during rotation of the rotation body; and the control portion can change starting position in a circumferential direction at which the rotation speed of the rotation body is changed.

According to the present invention, the control portion can change starting position in a circumferential direction at which a rotation speed of the rotation body is changed. Thus, a position of the rotation body where it comes into contact with a sheet can be changed, and prevent the rotation body from being worn locally, and to increase the lifetime of the rotation body.

Further feature of the present invention will become apparent from the following description of exemplary embodiments (with reference to the attached drawings).

DESCRIPTION OF THE EMBODIMENTS

An image forming apparatus will be described based on the drawings as one example of an image processing apparatus in a first embodiment of the present invention.

(Image Forming Apparatus)

Figure 1:
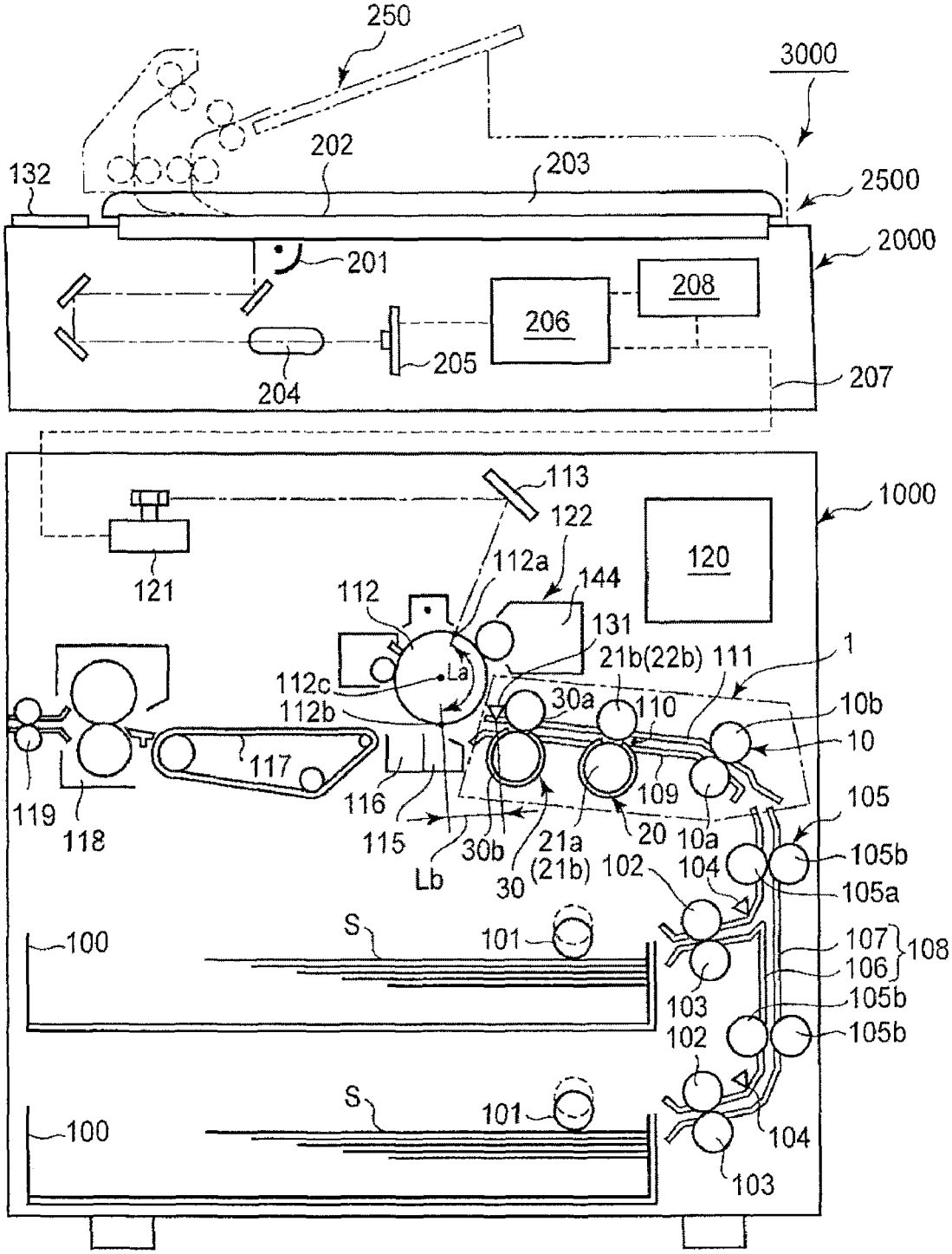
FIG. 1 is a sectional view of a copying machine which is one example of an image forming apparatus according to a first embodiment of the invention taken along the sheet conveying direction.

FIG. 1 is a sectional view of a copying machine which is one example of an image forming apparatus according to a first embodiment of the invention taken along the sheet conveying direction.

The image forming apparatus 3000 includes an image reading apparatus 2500 as an image processing apparatus and a printer 1000 as an image processing apparatus, and is operated under control of a controller 120.

In FIG. 1, a scanner 2000 and the printer 1000 are provided separately, but they may integrally be formed together.

To read originals, the scanner 2000 includes a scanning light source 201, a platen glass 202, an opening/closing original pressure plate 203, a lens 204, a light receiving element (photoelectric conversion) 205, an image converting portion 206 and a memory 208. The memory 208 stores an image processing signal which is processed by the image converting portion 206.

If an automatic original feeding apparatus 250 as illustrated with phantom lines is mounted on the scanner 2000 instead of the original pressure plate 203, the scanner 2000 can automatically read originals. The automatic original feeding apparatus 250 is provided with a sheet conveying apparatus or a sheet feeding device 50 like a later-described registration portion 1. Therefore, the image reading apparatus 2500 as the image processing apparatus comprises the scanner 2000 which is the image processing portion and the image reading portion with the automatic original feeding apparatus 250.

An original which is read by the scanning light source 201 is converted into an electric signal 207 which is encoded by the image converting portion 206 and sent to a laser scanner 121, or is once stored in the memory 208. The electric signal stored in the memory 208 is sent to the laser scanner 121 if necessary by a signal from the controller 120.

Sheets S accommodated in a cassette 100 in the printer 1000 are sent out from the cassette 100 by a pickup roller 101 which vertically moves and rotates, and the sheets S are separated from one another one sheet by one sheet by a feed roller 102 and a retard roller 103 and are fed. The sheets are conveyed through a conveying passage 108 comprising guide plates 106 and 107 by a pair of conveying rollers 105, and are received by a bent conveying passage 110 comprising guides 109 and 111. The sheets are further conveyed by a pair of assist rollers 10 and are guided by skew feeding correcting roller portions 20 and a pair of registration rollers 30. The pair of assist rollers 10, the skew feeding correcting roller portions 20 and the pair of registration rollers 30 comprise the registration portion 1. The skew feeding of the sheet is corrected by the registration portion 1 and the sheet is conveyed to the transfer portion 112*b*. The skew feeding correcting operation of the registration portion 1 will be described later.

A photosensitive drum 112 rotates rightward as viewed in FIG. 1. In the laser scanner 121, a mirror 113 is illuminated with laser light and the light is reflected and an exposure position 112*a* on the photosensitive drum 112 is illuminated with the light. The photosensitive drum 112 illuminated with laser light is formed with latent image. The development makes the image clear as a toner image by the development device 144. The toner image is conveyed from the exposure position 112*a* of the photosensitive drum 112 to the transfer portion 112*b* through a distance La.

A tip end of a sheet S which passed through the registration portion 1 is detected by a registration sensor 131, the sheet S is conveyed through the same distance Lb (distance from the registration sensor 131 to the transfer portion 112*b*) as the distance La, and during that time, a position correction is made to take synchronism with the tip end position of the toner image.

The toner image on the photosensitive drum 112 is transferred by the transfer portion 112*b* on the sheet which is charged by a transfer charger 115. The sheet onto which the toner image is transferred is electrostatically separated from the photosensitive drum 112 by a separating charger 116. The photo sensitive drum 112, the development device 144, the transfer charger 115 and the separating charger 116 comprise an image forming portion 122 as an image processing portion.

A transfer belt 117 conveys a sheet on which a toner image is transferred. A fixing device 118 fixes the toner image on the sheet. A discharge roller 119 discharges the sheet on which the image is formed out from the printer 1000.

The printer 1000 functions as a copying machine if a processing signal of the image forming portion is input to the laser scanner 121, and functions as a facsimile machine if a sending signal of a facsimile (FAX) is input, and functions as a printer if an output signal of a personal computer is input. On the contrary, the printer 1000 functions as a facsimile machine if a processing signal of the image converting portion 206 is sent to another facsimile machine.

Registration Portion in a Printer as the Image Processing Apparatus of the First Embodiment Next, the registration portion 1 which is the sheet conveying apparatus will be described based on FIGS. 2 to 11.

Figure 2:
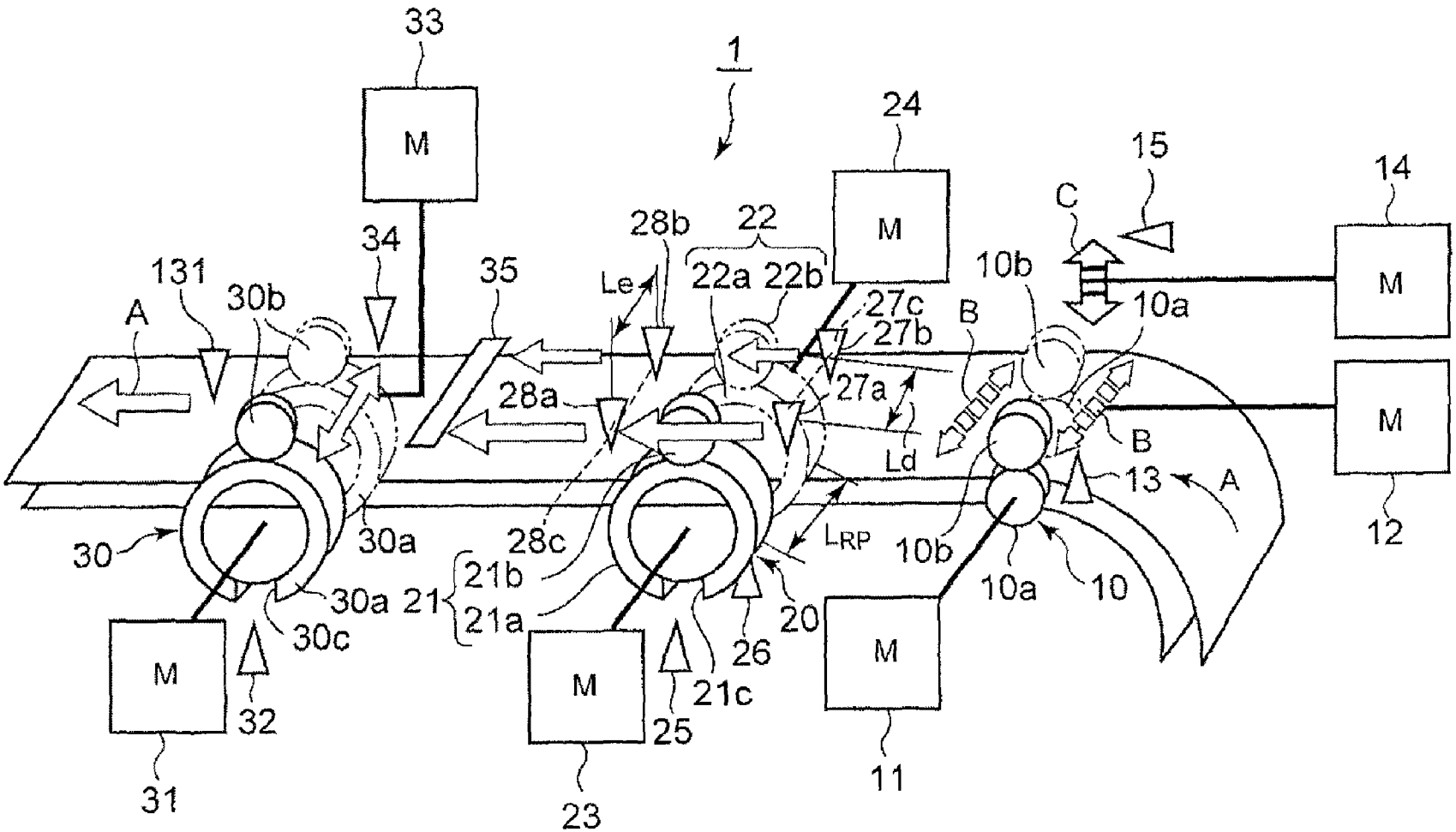
FIG. 2 is a schematic perspective view of a registration portion as a sheet conveying apparatus according to the embodiment of the invention.

In FIG. 2, the pair of assist rollers 10, the skew feeding correcting roller portions 20 and the pair of registration rollers 30 comprising the registration portion 1 are rotatably pivotally supported by a side plate of a frame (not illustrated).

Each of the pair of assist rollers 10 includes an assist drive roller 10*a* and an assist follower roller 10*b* which is pressed against the assist drive roller 10*a* by a pressing spring (not illustrated).

An assist motor 11 which rotates the assist drive roller 10*a* in the sheet conveying direction is connected to the assist drive roller 10*a*. An assist shift motor 12 which moves the pair of assist roller 10 in a direction (direction of the arrow B, widthwise direction of a sheet) intersecting with the sheet conveying direction (direction of the arrow A) is connected to the assist roller 10. An assist shift HP sensor 13 which detects whether the assist roller 10 is in its home position (HP) is disposed near the pair of assist roller 10. Thus, the pair of assist roller 10 can be on standby at the position illustrated with the solid line and can move between the solid line and the broken line.

An assist releasing motor 14 which releases the pressure welding state of the pair of assist roller 10 is connected to the assist follower roller 10*b*. The assist releasing HP sensor 15 is provide data position where the phase of the assist releasing motor 14 is detected.

The skew feeding correcting roller portions 20 include two pair of skew feeding correcting rollers 21 and 22 disposed at a predetermined distance LRP from each other in a direction intersecting with the sheet conveying direction, and skew feeding correcting motors 23 and 24. The skew feeding correcting roller portions 20 also include actuation sensors (which also function as skew feeding detection sensors) 27*a* and 27*b*, and skew feeding detection sensors 28*a* and 28*b*. The pair of skew feeding correcting rollers 21 and 22 includes C-shaped skew feeding correcting drive rollers 21*a* and 22*a* as bodies of rotation, and skew feeding correcting follower rollers 21*b* and 22*b* which are pressed against the skew feeding correcting drive rollers 21*a* and 22*a* by pressing spring (not illustrated).

The skew feeding correcting drive rollers 21*a* and 22*a* are independently (individually) rotated by skew feeding correcting motors 23 and 24. Skew feeding correcting HP sensors 25 and 26 as rotation body detectors are disposed at locations where openings 21*c* and 22*c* (FIG. 8) of the skew feeding correcting drive rollers 21*a* and 22*a* are detected, and set rotation starting positions (initial positions) of the skew feeding correcting drive rollers 21*a* and 22*a*. The skew feeding correcting drive rollers 21*a* and 22*a* can stop at the same position (same phase) in the circumferential direction based on the detections of the skew feeding correcting HP sensors 25 and 26. Thus, the skew feeding correcting drive rollers 21*a* and 22*a* can start rotating from the same stop positions (states). The actuation sensors 27*a* and 27*b* are disposed upstream in the conveying direction of the skew feeding correcting roller portions 20 at a predetermined distance LD in the direction (direction of the arrow B) intersecting with the sheet conveying direction, and the actuation sensors 27*a* and 27*b* detect a tip end of a sheet S. If the actuation sensors 27*a* and 27*b* detect the tip end of the sheet, the skew feeding correcting motors 23 and 24 start, and the actuation sensors 27*a* and 27*b* also detect the skew feeding of a sheet as will be described later.

Figure 9:
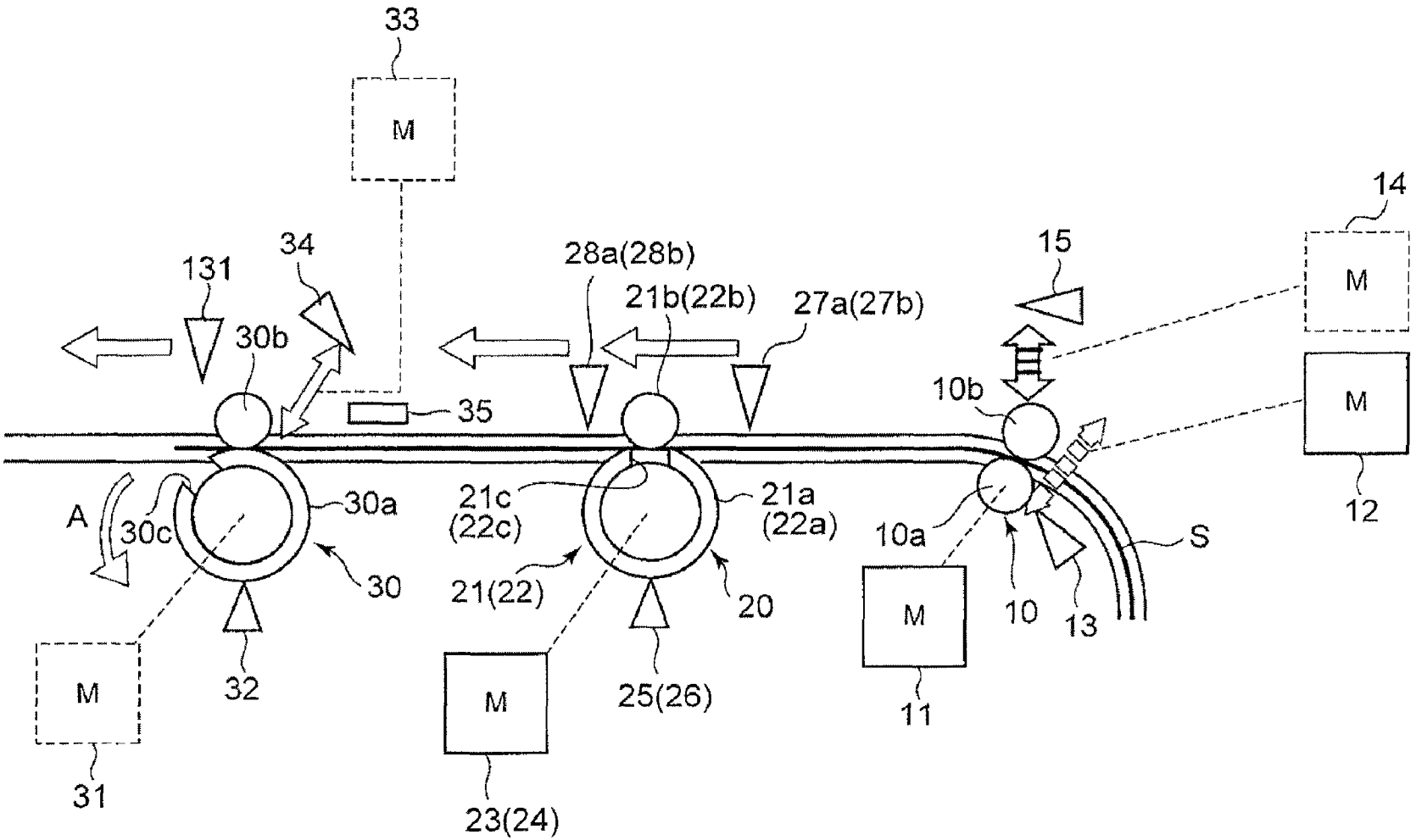
FIG. 9 is a diagram for describing tip registration and lateral registration correcting operation of a registration portion.

As illustrated in FIG. 9, when the openings 21*c* and 22*c* of the skew feeding correcting drive rollers 21*a* and 22*a* are opposed to the skew feeding correcting follower rollers 21*b* and 22*b*, roller nip portions between the skew feeding correcting drive rollers 21*a* and 22*a* and the skew feeding correcting follower rollers 21*b* and 22*b* are released. In this state, the pair of skew feeding correcting rollers 21 and 22 release the nip of a sheet so that a load is not applied to a sheet which is conveyed by the pair of registration rollers 30.

The skew feeding detection sensors 28*a* and 28*b* as skew feeding detectors which detect the skew feeding of a sheet are disposed downstream in the sheet conveying direction of the skew feeding correcting roller portions 20 at a predetermined distance Le from each other in a direction intersecting with the sheet conveying direction.

The pair of registration rollers 30 includes C-shaped registration drive rollers 30*a* as bodies of rotation, and registration follower rollers 30*b* pressed against the registration drive rollers 30*a* by pressing springs (not illustrated). The registration HP sensor 32 is disposed at a location where the opening 30*c* of the registration drive roller 30*a* is detected.

Figure 5:
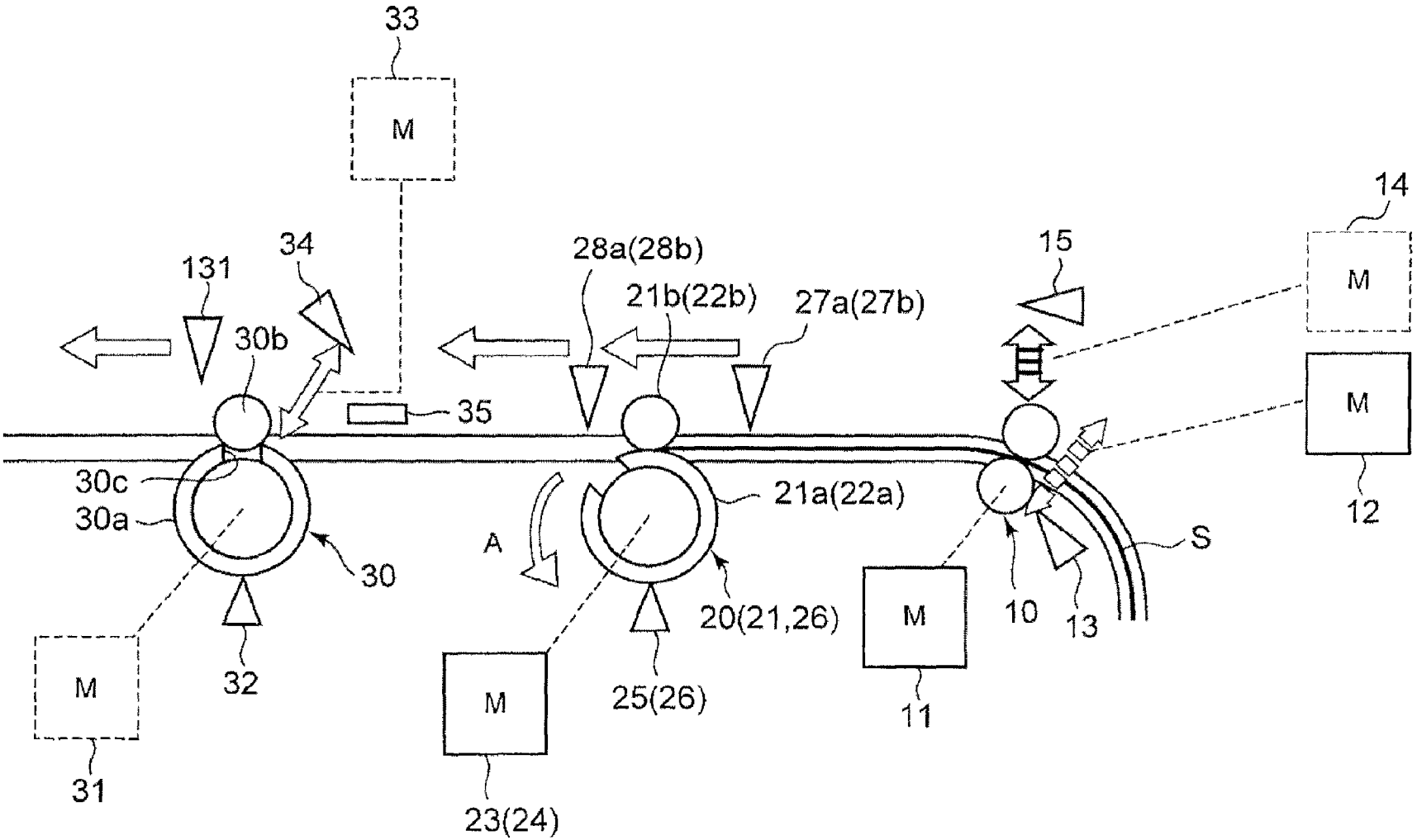
FIG. 5 is a diagram for describing a skew feeding correcting operation.

When the opening 30*c* of the registration drive roller 30*a* is opposed to the registration follower roller 30*b* as illustrated in FIG. 5, the roller nip portion between the registration drive roller 30*a* and the registration follower roller 30*b* is released. In this state, the pair of registration rollers 30 release the nip of a sheet sent by the pair of skew feeding correcting rollers 21 and 22 so that a load is not applied to a sheet whose skew feeding is corrected by the pair of skew feeding correcting rollers 21 and 22.

The registration drive roller 30*a* is rotated in the sheet conveying direction by a registration motor 31. A registration shift motor 33 which moves the pair of registration rollers 30 in a direction intersecting with the sheet conveying direction is connected to the pair of registration rollers 30. A registration shift HP sensor 34 which detects whether the pair of registration rollers 30 are in their home positions (HP) is disposed near the pair of registration rollers 30. Thus, the pair of registration rollers 30 can be on standby at the positions illustrated with the solid line and can move between the solid line and the broken line.

A lateral registration detection sensor 35 which detects a lateral registration position of a sheet S is disposed upstream in the sheet conveying direction of the pair of registration rollers 30 in a direction intersecting with the sheet conveying direction. The registration sensor 131 which detects the tip end of a sheet S is disposed downstream of the pair of registration rollers 30.

A moving direction of the pair of assist rollers 10 and the pair of registration rollers 30, an arrangement direction of the pair of skew feeding correcting rollers 21 and 22, and center lines 27*c* and 28*c* of the actuation sensors 27*a* and 27*b* and the skew feeding detection sensors 28*a* and 28*b* are in parallel to an axis 112*c* of the photosensitive drum 112 (FIG. 1). The axis 112*c* is in parallel to a direction (widthwise direction of sheet) intersecting with the sheet conveying direction.

It is preferable that a distance LRP between the pair of skew feeding correcting rollers 21 and 22, a distance Ld between the actuation sensors 27*a* and 27*b*, and a distance Le between the skew feeding detection sensors 28*a* and 28*b* are equal to or less than a width of a sheet having the smallest width among conveyed sheets.

Figure 3:
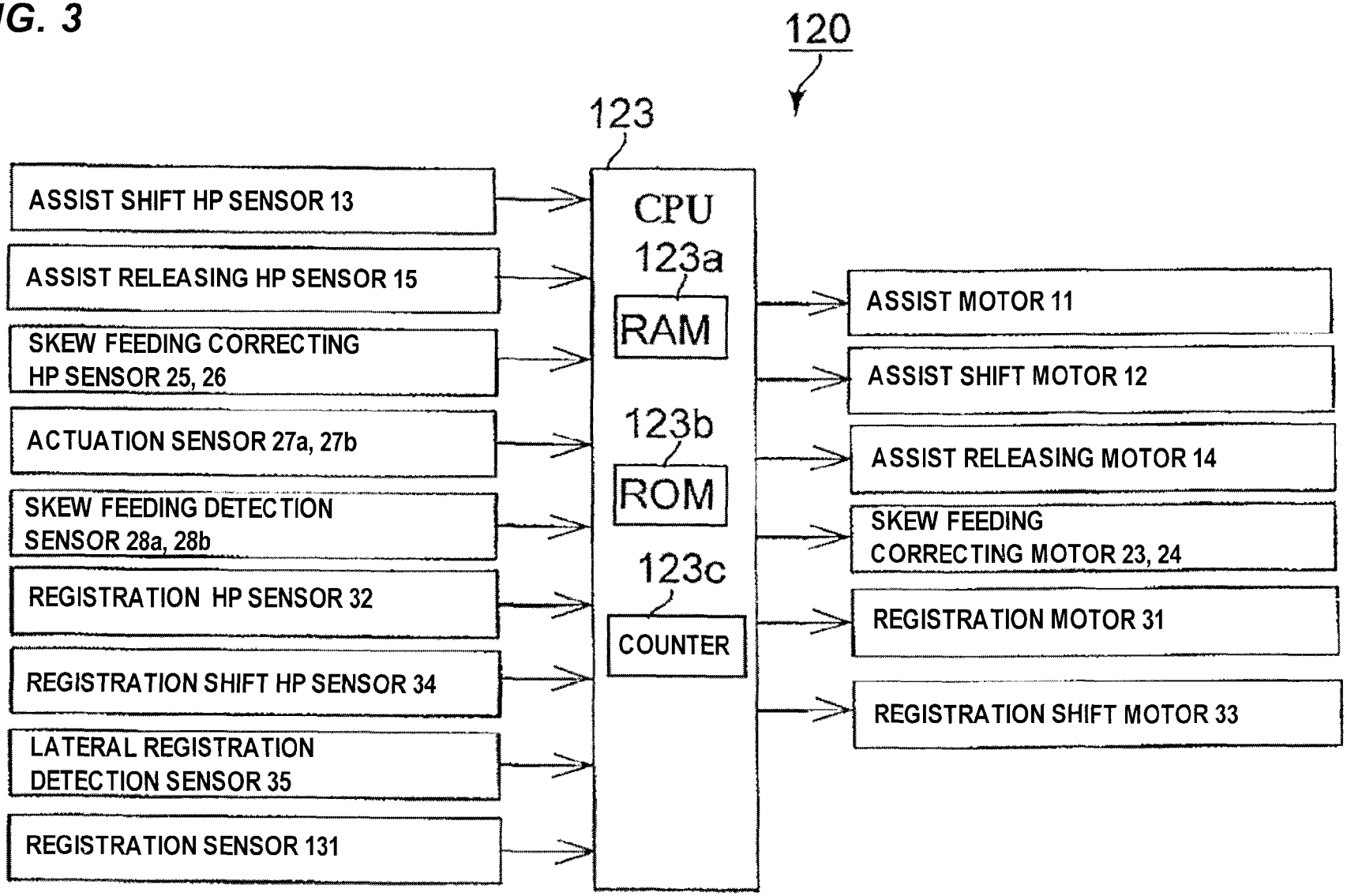
FIG. 3 is a control block diagram relating to the registration portion in control of the copying machine.

FIG. 3 is a control block diagram relating to the registration portion 1 in the controller 120 as a control portion. The assist motor 11, the assist shift motor 12, the assist releasing motor 14, the skew feeding correcting motor 23 and 24, the registration motor 31 and the registration shift motor 33 are connected to a CPU 123 of the controller 120. Further, the assist shift HP sensor 13, the assist releasing HP sensor 15, the skew feeding correcting HP sensor 25 and 26, the actuation sensor 27*a* and 27*b*, the skew feeding detection sensor 28*a* and 28*b*, the registration HP sensor 32 and the registration shift HP sensor 34 are connected to the CPU 123. The lateral registration detection sensor 35 and the registration sensor 131 are also connected to the CPU 123.

Figure 4:
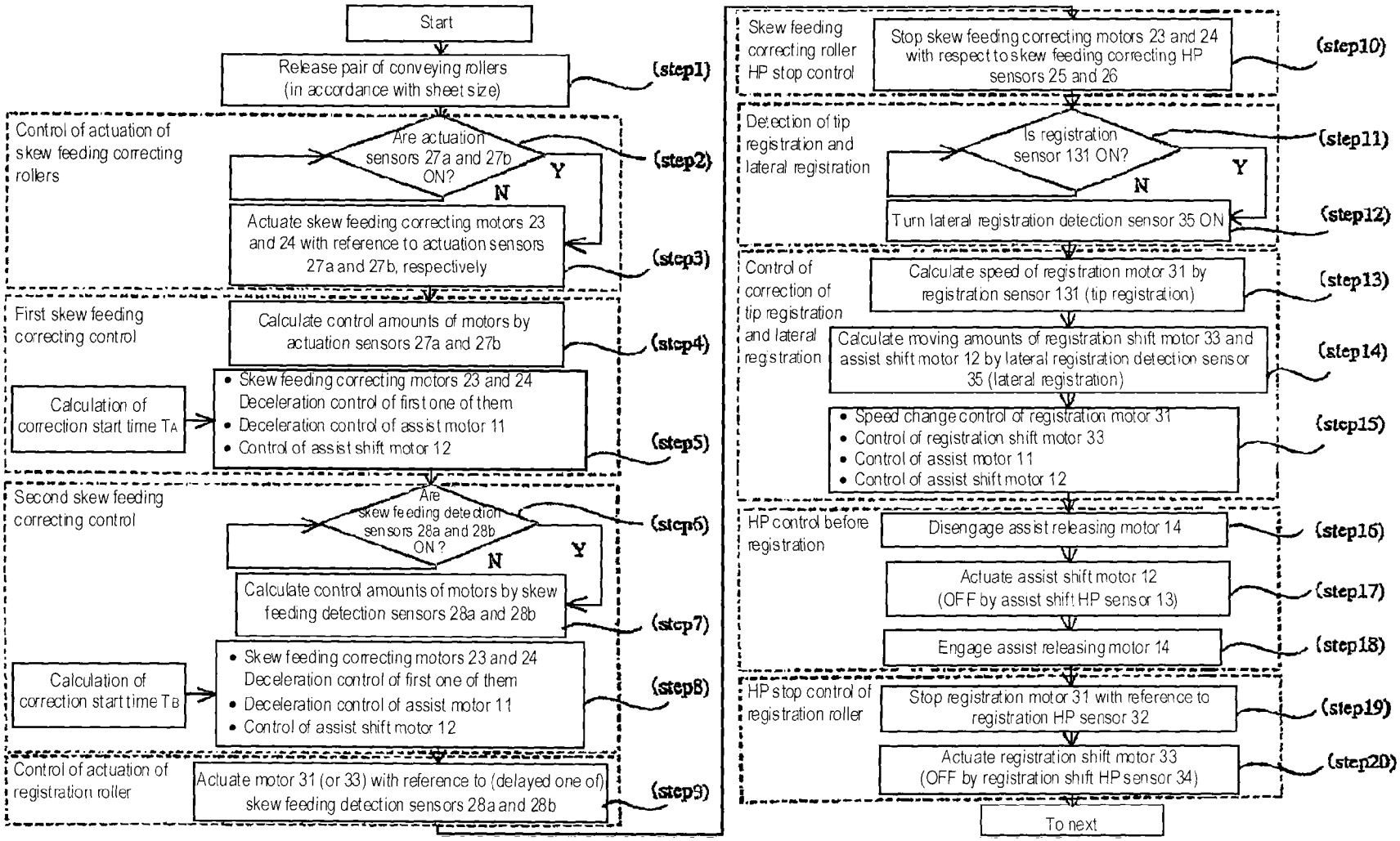
FIG. 4 is a flowchart for describing operation of the registration portion.
Figure 6:
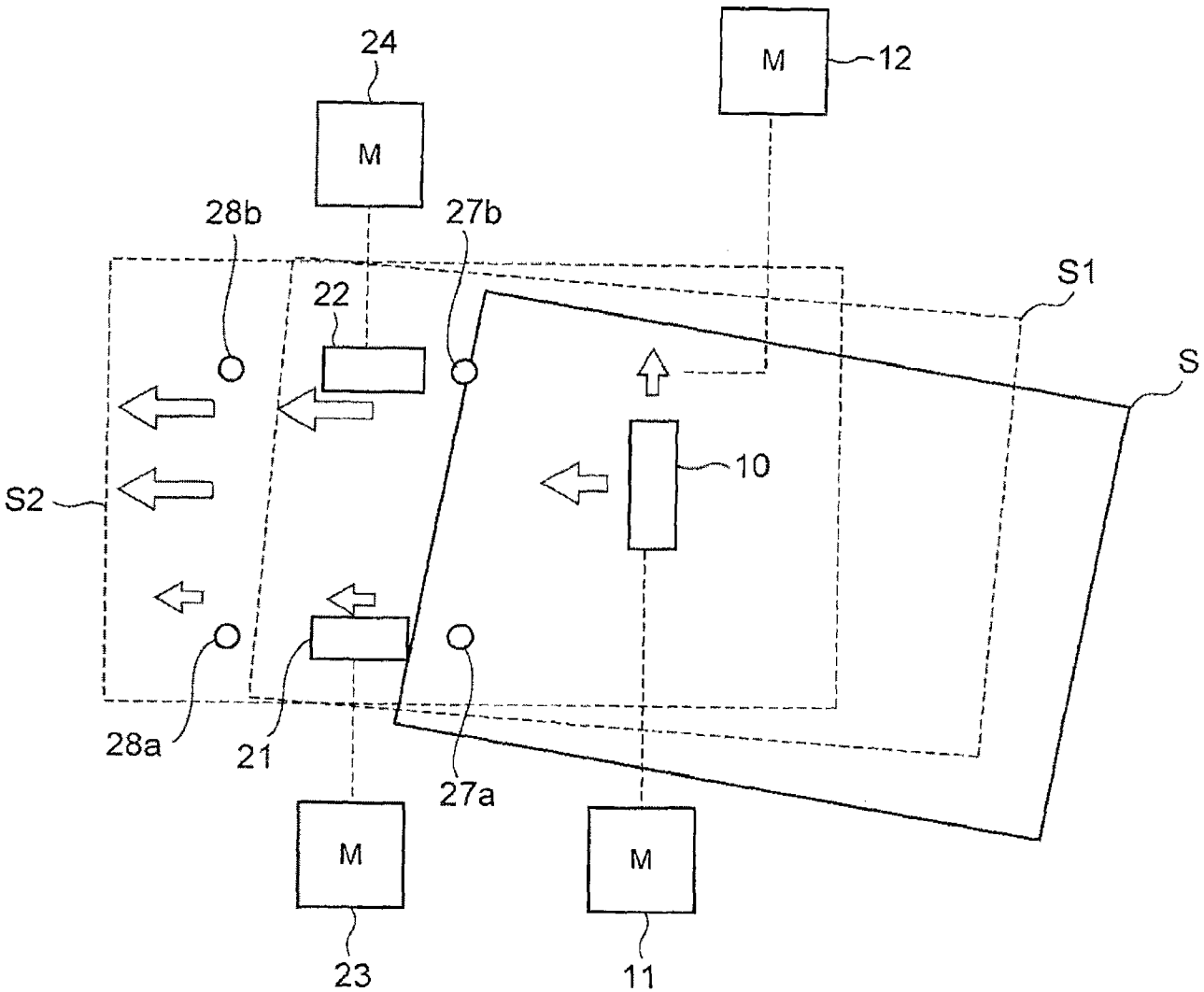
FIG. 6 is a diagram for describing the skew feeding correcting operation.
Figure 7:
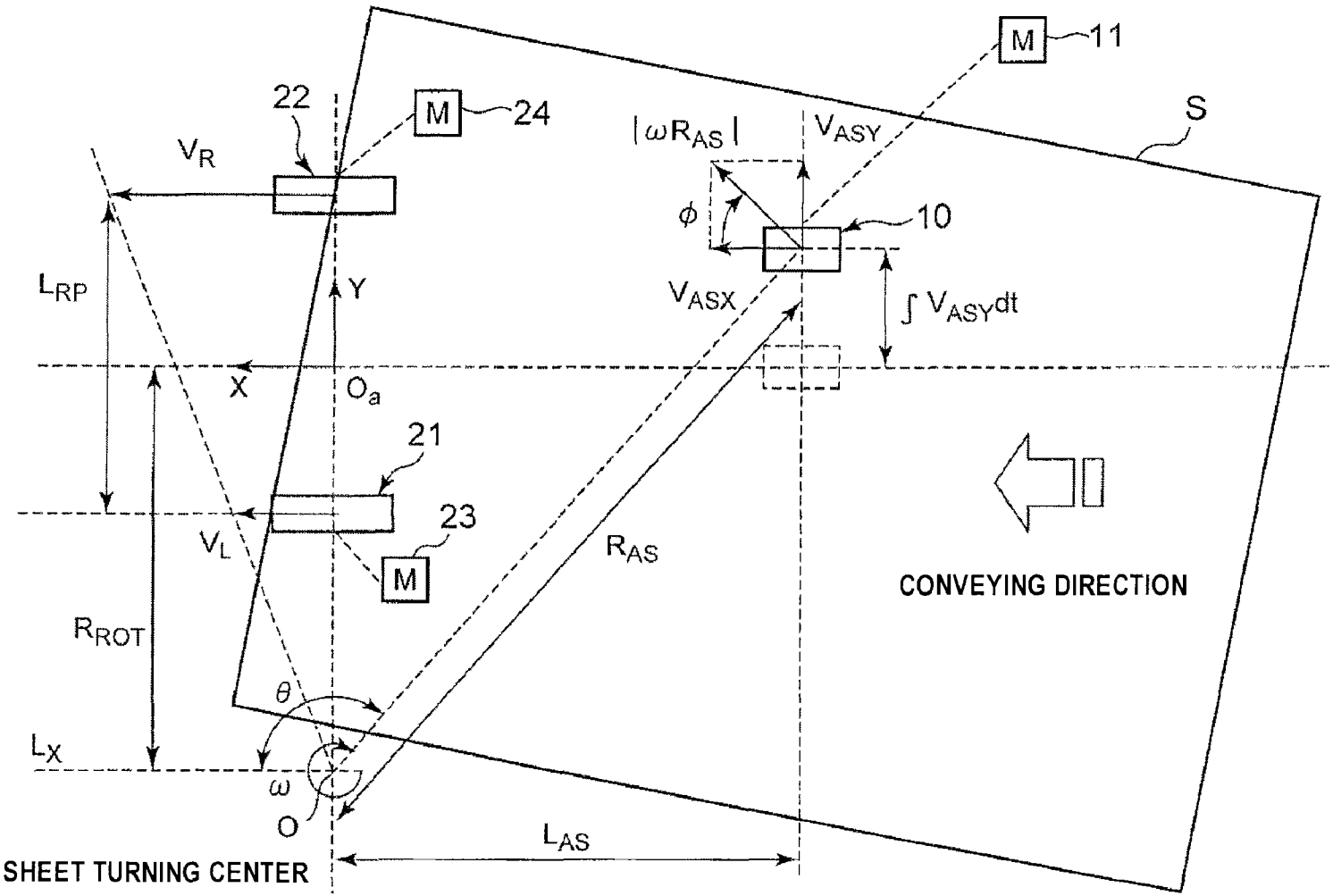
FIG. 7 is a diagram for describing the skew feeding correcting operation.
Figure 8:
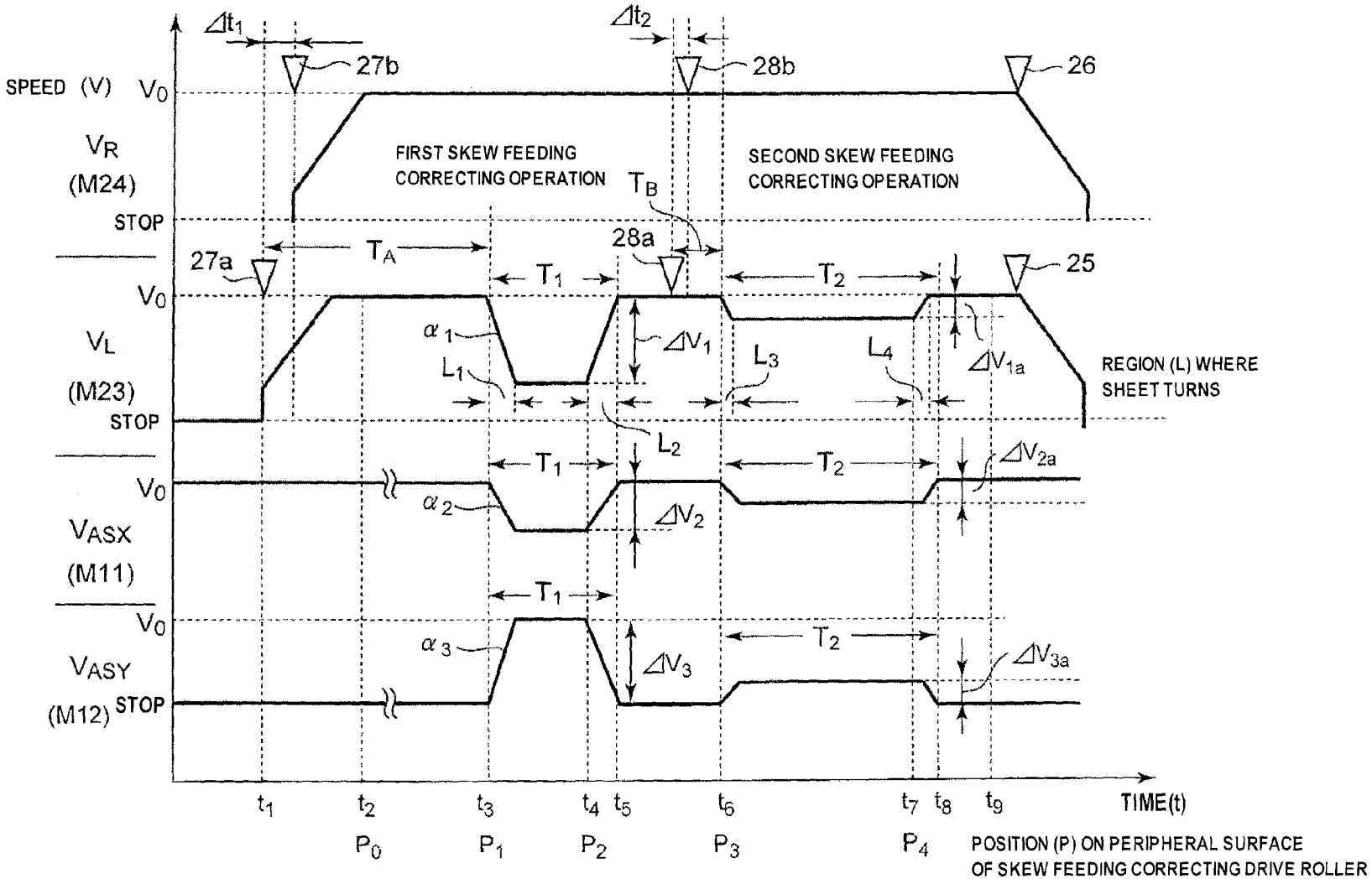
FIG. 8 is a time chart for describing the skew feeding correcting operation of the registration portion.
Figure 10:
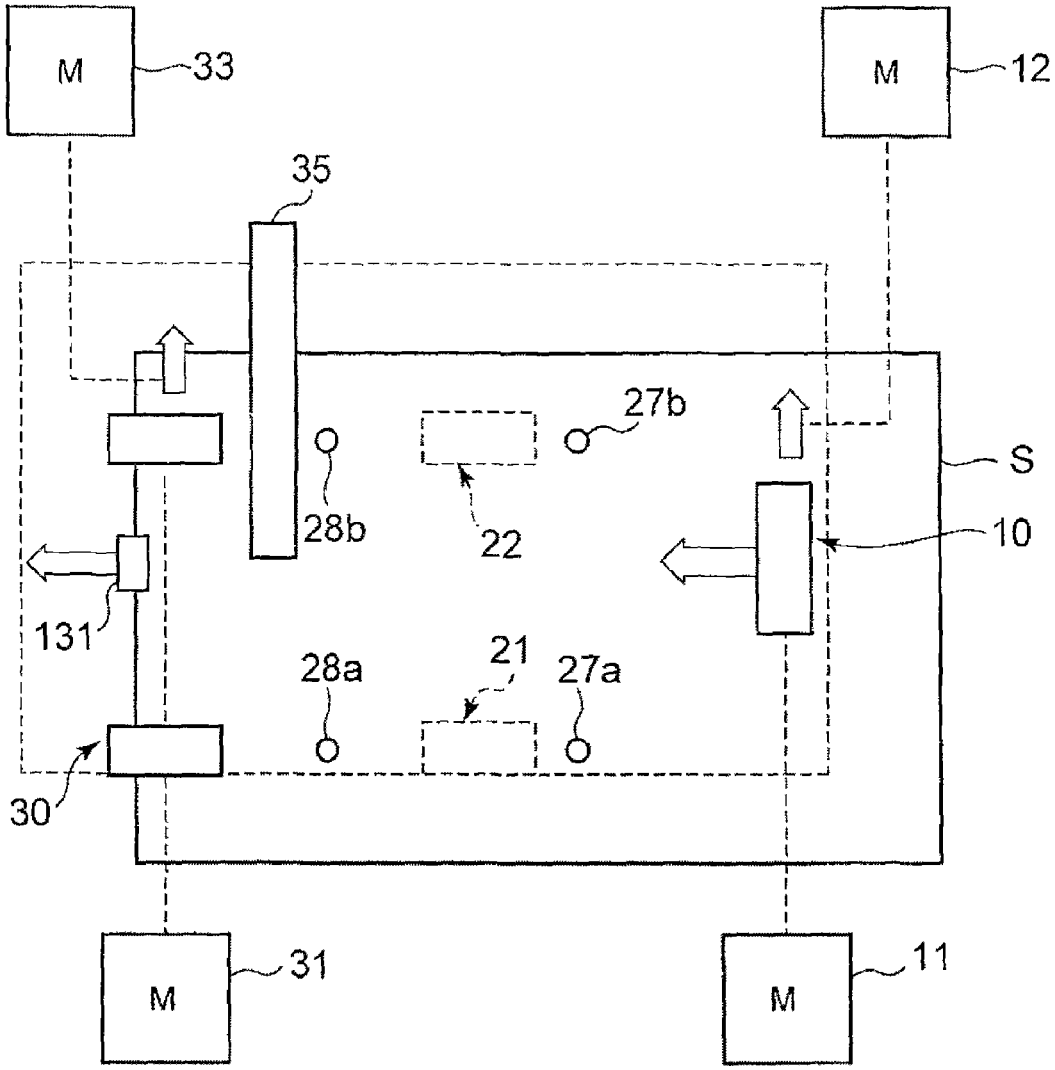
FIG. 10 is a diagram for describing the tip registration and lateral registration correcting operation of the registration portion.
Figure 11A:
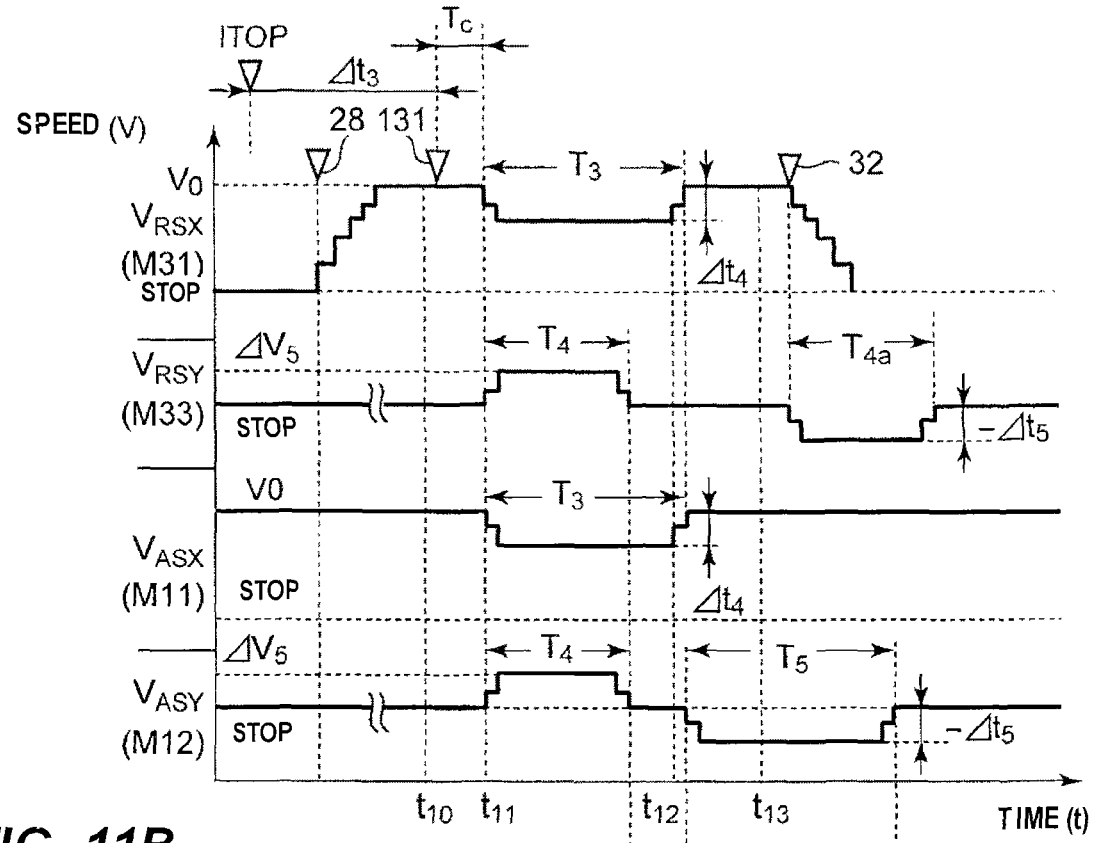
FIG. 11 is a time chart for describing the tip registration and lateral registration correcting operation of the registration portion.
Figure 11B:
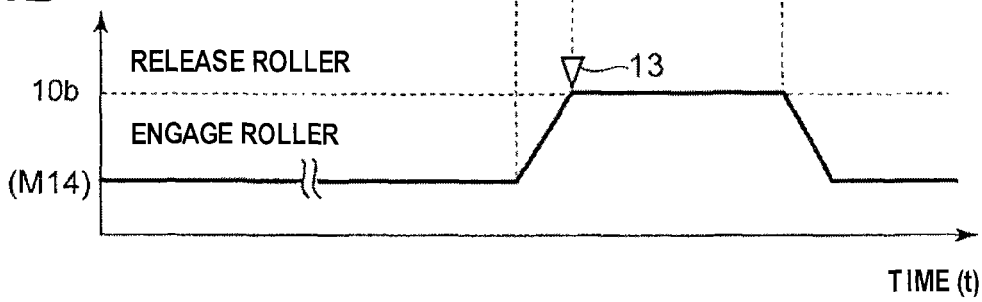
Figure 12A:
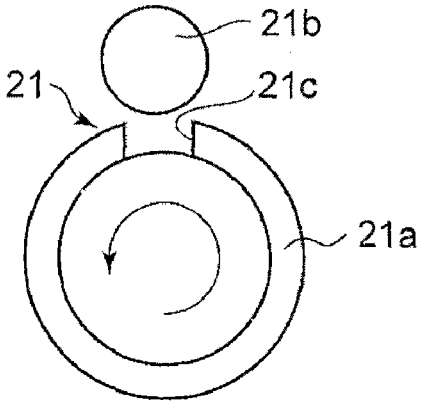
FIG. 12 is a diagram illustrating a rotation position (position of an opening) of a skew feeding correcting drive rollers in each time illustrated in FIG. 8.
Figure 12B:
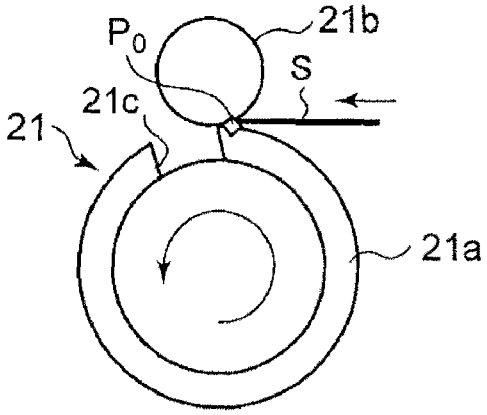
Figure 12C:
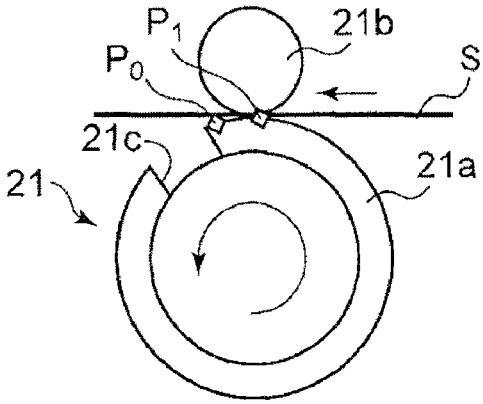
Figure 12D:
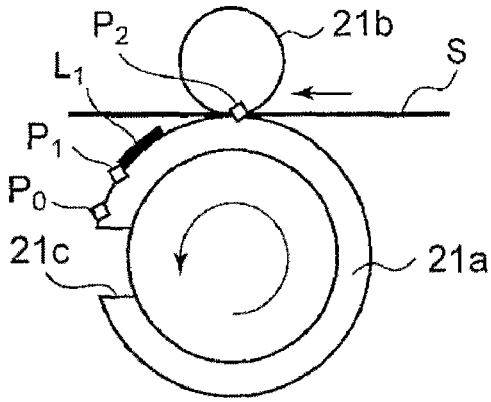
Figure 13A:
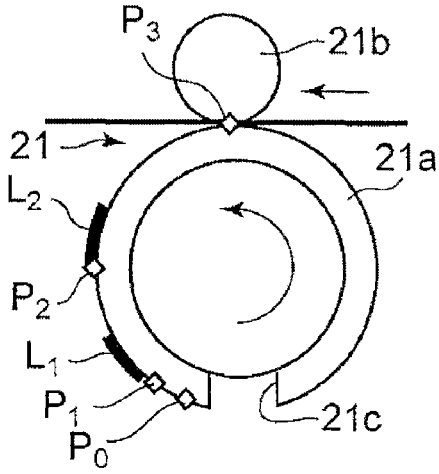
FIG. 13 is a diagram illustrating the rotation position (position of an opening) of the skew feeding correcting drive rollers in each time illustrated in FIG. 8 subsequent to FIG. 12.
Figure 13B:
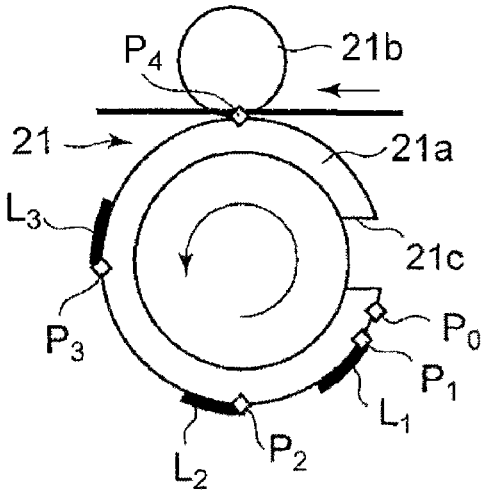
Figure 13C:
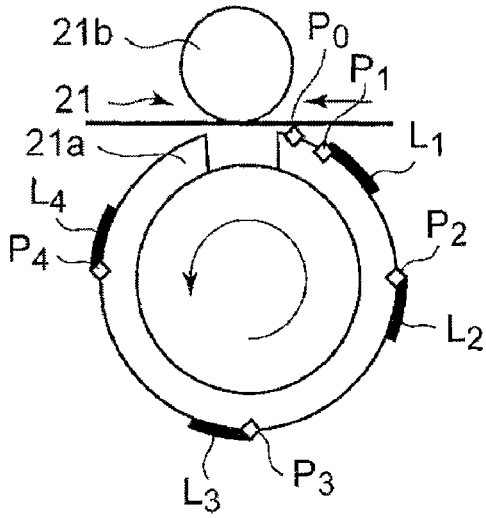
Figure 13D:
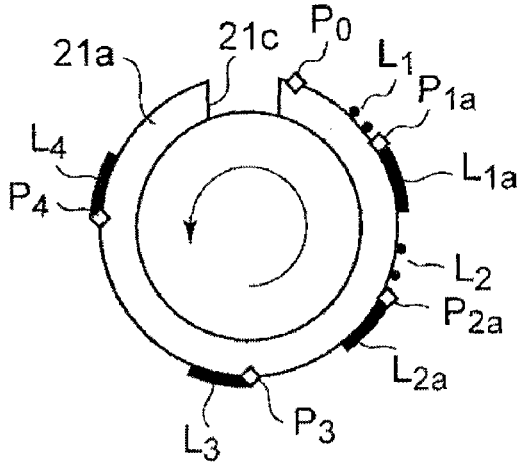

Next, the skew feeding correcting operation of a sheet in the registration portion 1 will be described based on FIGS. 2 and 4 to 11. FIG. 4 is a flowchart for describing the skew feeding correcting operation. FIGS. 5 to 7 are diagrams for describing the skew feeding correcting operation. FIG. 8 is a time chart for describing the skew feeding correcting operation. FIGS. 9 and 10 are diagrams for describing tip registration and lateral registration correcting operation. FIG. 11 is a time chart for describing the tip registration and lateral registration correcting operation.

A sheet S which is fed from the cassette 100 as the sheet storage portion is sent to the pair of assist rollers 10 by the pair of conveying rollers 105. The follower roller 105*b* of the pair of conveying rollers 105 is separated from the drive roller 105*a* by a roller releasing motor (not illustrated) if necessary for each size of sheets and release the nip of the pair of conveying rollers 105 (Step 1). If the actuation sensors 27*a* and 27*b* detect a tip end of a sheet S conveyed by the pair of assist rollers 10 (Step 2), the CPU 123 actuates the skew feeding correcting motors 23 and 24 based on the detection operations of the sensors (Step 3). Then, the pair of skew feeding correcting rollers 21 and 22 whose roller nip was released rotate in the direction of the arrow A and start conveying the sheet S.

If a tip end of a sheet S is detected by the actuation sensors 27*a* and 27*b*, the CPU 123 calculates the skew feeding amount of the tip end of the sheet S based on a detection time difference Δt1 illustrated in FIG. 8 of the actuation sensors 27*a* and 27*b*. When the actuation sensor 27*a* detects the sheet first, the CPU 123 decelerates the pair of skew feeding correcting rollers 21 (skew feeding correcting motor 23) and calculates a correction time T1 and a deceleration speed ΔV1 which are control parameters for carrying out the skew feeding correction such that the following equation 1 is satisfied. In this embodiment, the conveying speed V0 is a sheet conveying speed in a state where speed control concerning the skew feeding correction is not performed.

$$V_0 \times \Delta t_1 = \int_{T_1} \Delta V_1 \, dt \qquad \text{[Equation 1]}$$

The sheet conveying speed of the pair of assist rollers 10 in the sheet conveying direction is obtained based on FIG. 7. When conveying speeds of the pair of skew feeding correcting rollers 21 and 22 at the time of correction are defined as VL and VR, and a thrust pitch between the pair of skew feeding correcting rollers 21 and 22 is defined as LRP, a rotation speed ω around a turning center O of a sheet S is as illustrated in the following equation 2.

$$\omega = \frac{V_R - V_L}{L_{RP}} \qquad \text{[Equation 2]}$$

A turning distance RROT between a turning center O of a sheet S and a midpoint Oa between the pair of skew feeding correcting rollers 21 and 22 is as illustrated in the following equation 3.

$$R_{ROT} = \frac{V_L + V_R}{2|V_R - V_L|} \cdot L_{RP} \qquad \text{[Equation 3]}$$

If a speed of the pair of assist rollers 10 in the conveying direction is defined as VASX and a speed in the thrust direction is defined as VASY and a distance between the pair of skew feeding correcting rollers 21 and 22 and the pair of assist rollers 10 is defined as LAS, a turning distance RAS between the turning center O of the sheet S and the pair of assist rollers 10 is as illustrated in the following equation 4.

$$R_{AS} = \sqrt{L_{AS}^2 + (R_{ROT} + \int V_{ASY} dt)^2} \qquad \text{[Equation 4]}$$

An angle θ formed between the pair of assist rollers 10 and a line Lx extending through the turning center O of the sheet S along the sheet conveying direction, and an angle ϕ formed between the pair of assist rollers 10 and the synthetic conveying speed |ωRAS| are obtained by the following equation 5.

$$\phi = \theta - \pi/2 \qquad \text{[Equation 5]}$$

From the above, the speed VASX of the pair of assist rollers 10 in the conveying direction and the speed VASY in the thrust direction are obtained from the following equations 6 and 7.

$$V_{ASX} - |\omega R_{AS}| \cdot \cos\phi - \left|\omega \cdot \left(R_{ROY} + \int V_{ASY} dt\right)\right| - \frac{V_L + V_R}{2} + \frac{|V_L - V_R| \cdot \int V_{ASY} dt}{L_{RP}} \qquad \text{[Equation 6]}$$

$$V_{ASY} = -\omega R_{AS} \cdot \sin\phi = -\omega L_{AS} = \frac{L_{AS}}{L_{RP}}(V_L - V_R) \qquad \text{[Equation 7]}$$

When the skew feeding amount is sufficiently small, since it is close to the following equation 8, $$\int V_{ASY} dt \equiv 0 \quad \text{[Equation 8]}$$

the speeds can be obtained from the following equations 9 and 10.

$$V_{ASX} \equiv \frac{V_L + V_R}{2} \quad \text{[Equation 9]}$$

$$V_{ASY} \equiv \frac{L_{AS}}{L_{RP}}(V_L - V_R) \quad \text{[Equation 10]}$$

Thus, speeds of the correction motor 23, the assist motor 11 and the assist shift motor 12 can be calculated using the following equations 11 and 12.

$$\Delta V_2 \equiv \Delta V_2/2 \quad \text{[Equation 11]}$$

$$\Delta V_3 \equiv \Delta V_1 \times L_{AS}/L_{RP} \quad \text{[Equation 12]}$$

Various control parameters for carrying out the skew feeding correction are calculated using the equations 1, 11 and 12 (Step 4). If the actuation sensors 27*a* and 27*b* detect a tip end of a sheet, the motors 23 and 24 accelerate from the stop state to VO. The assist motor 11 is driven at a steady speed VO except when the skew feeding correction is carried out. The assist shift motor 12 stops except when the skew feeding correction is carried out. The skew feeding correcting motor 23 starts decelerating halfway of rotation for the first skew feeding correcting operation when correction start time TA (FIG. 8) obtained by a later-described calculation is elapsed after the actuation sensor 27*a* detects the tip end of the sheet S (TA>Δt1). The correction start time TA shows timing at which the rotation speed is changed after the skew feeding correcting drive roller 21*a* starts rotating. The skew feeding correcting motor 23 decelerates by ΔV1 at acceleration α1 from the conveying speed VO halfway of rotation of the skew feeding correcting drive roller 21*a* in the section of the first skew feeding correction, and when the skew feeding correction section is completed, the skew feeding correcting motor 23 again accelerates to the conveying speed VO, and makes the first skew feeding correction. At that time, the assist motor 11 simultaneously decelerates by ΔV2 at the acceleration α2 from the conveying speed VO, and when the skew feeding correction section is completed, the assist motor 11 again accelerates to the conveying speed VO. The assist shift motor 12 accelerates to ΔV3 at the acceleration α3, and stops when the skew feeding correction section (T1) is completed.

As illustrated in FIG. 8, the CPU 123 controls the skew feeding correcting motors 23 and 24, the assist motor 11 and the assist shift motor 12, and makes the first skew feeding correction (Step 5). With this, the skew feeding of the sheet is corrected as illustrated with a symbol S1 in FIG. 6. When the first skew feeding correction is completed, the skew feeding correcting drive rollers 21*a* and 22*a* are at positions where the openings 21*c* and 22*c* are aligned with each other in the axial direction (phases of rollers are the same).

After the first skew feeding correcting operation of a sheet S is completed, the downstream skew feeding detection sensors 28*a* and 28*b* detect skew feeding of a sheet S which could not be corrected in the first skew feeding correcting operation (Step 6). The CPU 123 calculates various control parameters for carrying out the second skew feeding correcting operation like the first skew feeding correcting operation based on the detections of the skew feeding detection sensors 28*a* and 28*b* (Step 7), and the second skew feeding correcting operation is carried out (Step 8). Like the first skew feeding correcting operation, the correction start time TB elapsed until the second skew feeding correcting operation is started after the skew feeding detection sensors 28*a* and 28*b* detect a tip end of a sheet can be obtained by a later-described processing (TB>Δt2). Here, the Δt2 is a detection time difference between the skew feeding detection sensors 28*a* and 28*b*. With this, skew feeding is corrected precisely as illustrated with a symbol S2 in FIG. 6.

Here, second correction time T2 illustrated in FIG. 8 is time corresponding to first correction time T1. Second deceleration speeds ΔV1*a*, ΔV2*a* and ΔV3*a* are speeds corresponding to first deceleration speeds ΔV1, ΔV2 and ΔV3.

A sheet S whose skew feeding was corrected by the pair of skew feeding correcting rollers 21 and 22 is conveyed to the pair of registration rollers 30. The registration motor 31 is actuated (Step 9) based on a detection operation of one of the skew feeding detection sensors 28*a* and 28*b* that detects a tip end of a sheet later (based on a delay side). As illustrated in FIG. 5, the opening 30*c* of the registration drive roller 30*a* is opposed to the registration follower roller 30*b*, the pair of registration rollers 30 whose roller nip was released is rotated in the direction of the arrow A in FIG. 9, and nip the sheet S and conveys the same. If the sheet S is nipped by the pair of registration rollers 30, the skew feeding correcting motors 23 and 24 stop rotation at the same position (same phase) in the circumferential direction relative to the fact that the openings 21*c* and 33*c* of the pair of skew feeding correcting rollers 21 and 22 are detected by the skew feeding correcting HP sensors 25 and 26. As a result, the pair of skew feeding correcting rollers 21 and 22 stop rotation (Step 10) in a state where the openings 21*c* and 22*c* of the skew feeding correcting drive rollers 21*a* and 22*a* are opposed to the skew feeding correcting follower rollers 21*b* and 22*b* (in a state where nip of the pair of rollers is released).

Then, the registration sensor 131 detects a tip end of a sheet S (Step 11), and the lateral registration detection sensor 35 detects a position of a side end of the sheet S (Step 12). The side end of the sheet is an edge of the sheet extending along the sheet conveying direction.

The CPU 123 obtains a time difference Δt3 between the detection timing of the registration sensor 131 and the timing (ITOP (FIG. 11)) at which the photosensitive drum 112 is illuminated with laser light. To bring the tip end of the toner image on the photosensitive drum 112 (FIG. 1) and the tip end of the sheet S into alignment with each other, the CPU 123 calculates deceleration speeds ΔV4 of the registration motor 31 and the assist motor 11 and the speed change time T3 based on the time difference Δt3 (Step 13).

The CPU 123 bring the lateral registration position of the toner image on the photosensitive drum 112 and the lateral registration position of the sheet S into alignment with each other based on a detection signal of the lateral registration detection sensor 35 (FIG. 2). To this end, the CPU 123 calculates speeds ΔV5 of the registration shift motor 33 and the assist shift motor 12 in the shift direction, and the speed change time T4 (Step 14).

If the CPU 123 controls the registration motor 31, the registration shift motor 33, the assist motor 11 and the assist shift motor 12 in this manner, a tip end and a side end of a sheet can match with a tip end and a side end of a toner image on the photosensitive drum (Step 15).

If the shifting operation of a sheet S is completed, the assist follower roller 10*b* of the pair of assist rollers 10 is separated from the assist drive roller 10*a* by the assist releasing motor 14 (Step 16), and releases the nip of the pair of assist rollers 10. The nip release of the pair of assist rollers 10 is detected by the assist releasing HP sensor 15 (FIG. 2). Then, the assist shift motor 12 starts, and shift-moves the pair of assist rollers 10 in the direction opposite from the Step 15 until the pair of assist rollers 10 are detected by the assist shift HP sensor 13, and stops (Step 17).

At that time, since the pair of assist rollers 10 move in the shift direction by the correction amounts of the first and second skew feeding correcting operations and the lateral registration, the pair of assist rollers 10 are shift-moved by speed change time T5 (FIG. 11) at speed −ΔV5 by the assist shift motor 12.

The registration shift motor 33 shift-moves the pair of registration rollers 30 by speed change time T4*a* at speed −ΔV5 in the shift direction, and returns the same to the original position. The minus symbol of the speed −ΔV5 means that the registration shift motor 33 and the assist shift motor 12 are rotated reversely with respect to the speed ΔV5. The speed change time T4*a* has substantial the same length as the speed change time T4.

If the rear end of the sheet S passes the pair of assist rollers 10, the pair of assist rollers 10 again return to the nip state by the assist releasing motor 14 (Step 18).

A toner image of the photosensitive drum 112 is transferred to the sheet S conveyed by the pair of registration rollers 30. The registration motor 31 stops relative to the fact that the registration HP sensor 32 detects the opening 30*c* of the registration drive roller 30*a* (Step 19). As a result, the pair of registration rollers 30 stop rotation in a state where the opening 30*c* of the registration drive roller 30*a* is opposed to the registration follower roller 30*b* and the nip is released as illustrated in FIG. 5. At the same time, the registration shift motor 33 starts, the registration shift motor 33 shift-moves the pair of registration rollers 30 in a direction opposite from that in Step 15 and stop the pair of registration rollers 30 (Step 20).

The shift portion 1 repeats the operations Steps 1 to 20, and precisely and continuously carry out the skew feeding correcting operation of sheets S, and position correcting operation between a sheet S and an image on the photosensitive drum 112.

Next, correction start time TA and TB will be described.

As described above, the registration portion 1 reduces deterioration of the precision of the skew feeding correcting operation by the machining error of the pair of skew feeding correcting rollers 21 and 22, and easily release the roller nip and switch the pressurization, and the registration portion 1 aligns the phases of the pair of skew feeding correcting rollers 21 and 22 whenever the conveying operation of sheets is started. Here, alignment of phases means that openings 21*c* and 22*c* of the skew feeding correcting drive rollers 21*a* and 22*a* of the pair of skew feeding correcting rollers 21 and 22 in the axial direction are aligned. A later-described phase control means control for aligning the openings 21*c* and 22*c* in the axial direction.

FIG. 8 illustrates a relation between a rotation position (position of the opening 21*c*) of the skew feeding correcting drive roller 21*a* which controls phases and the acceleration/deceleration timing of each motor when attention is paid to the pair of skew feeding correcting rollers (e.g., pair of skew feeding correcting rollers 21) which carry out the acceleration/deceleration control as the skew feeding correcting operation.

FIGS. 12(*a*) to (*d*) and FIGS. 13(*a*) to (*d*) illustrate the rotation position) position of the opening 21*c*) of the skew feeding correcting drive roller 21*a* at each time illustrated in FIG. 8.

In FIGS. 12 and 13, a symbol P0 illustrates a nip-starting position on the roller peripheral surface where the skew feeding correcting drive roller 21*a* starts nipping a tip end of a sheet. A symbol P1 illustrates a first deceleration starting position where the deceleration for the first skew feeding correcting operation is starting during rotation of the skew feeding correcting drive roller 21*a*. A symbol P2 illustrates a first acceleration starting position where acceleration for the first skew feeding correcting operation is started (returning to the original speed V0). A symbol P3 illustrates a second deceleration starting position where deceleration for the second skew feeding correcting operation is started during rotation of the skew feeding correcting drive roller 21*a*. A symbol P4 illustrates a second acceleration starting position where acceleration for the second skew feeding correcting operation is started (returning to the original speed V0). The symbols P1 to P4 illustrate positions on the roller peripheral surface of the skew feeding correcting drive roller 21*a* in the rotation direction.

Symbols L1, L2, L3 and L4 show regions where a sheet turns in a nip between the skew feeding correcting drive roller 21*a* and the skew feeding correcting follower roller 21*b* with turning acceleration, and these regions are located downstream of the symbols P1, P2, P3 and P4. That is, the regions L1, L2, L3 and L4 are wearing regions where inertial resistance of a sheet is generated and slip between the skew feeding correcting drive roller 21*a* and a sheet becomes extremely great as compared with other regions when a sheet is turned and accelerated. Thus, a conveying force at the wearing regions L1, L2, L3 and L4 is reduced in many cases.

Here, the first deceleration starting position P1 on the skew feeding correcting drive roller 21*a* is determined by the correction start time TA. The first acceleration starting position P2 on the skew feeding correcting drive roller 21*a* is automatically determined by a calculation result illustrated in (Step 4) in FIG. 4 when a phase of the first deceleration starting position P1 is determined. However, the first acceleration starting position P2 is distributed with a width in the rotation direction of the skew feeding correcting drive roller 21*a* to some extent in accordance with a skew feeding amount of a sheet.

Figure 14:
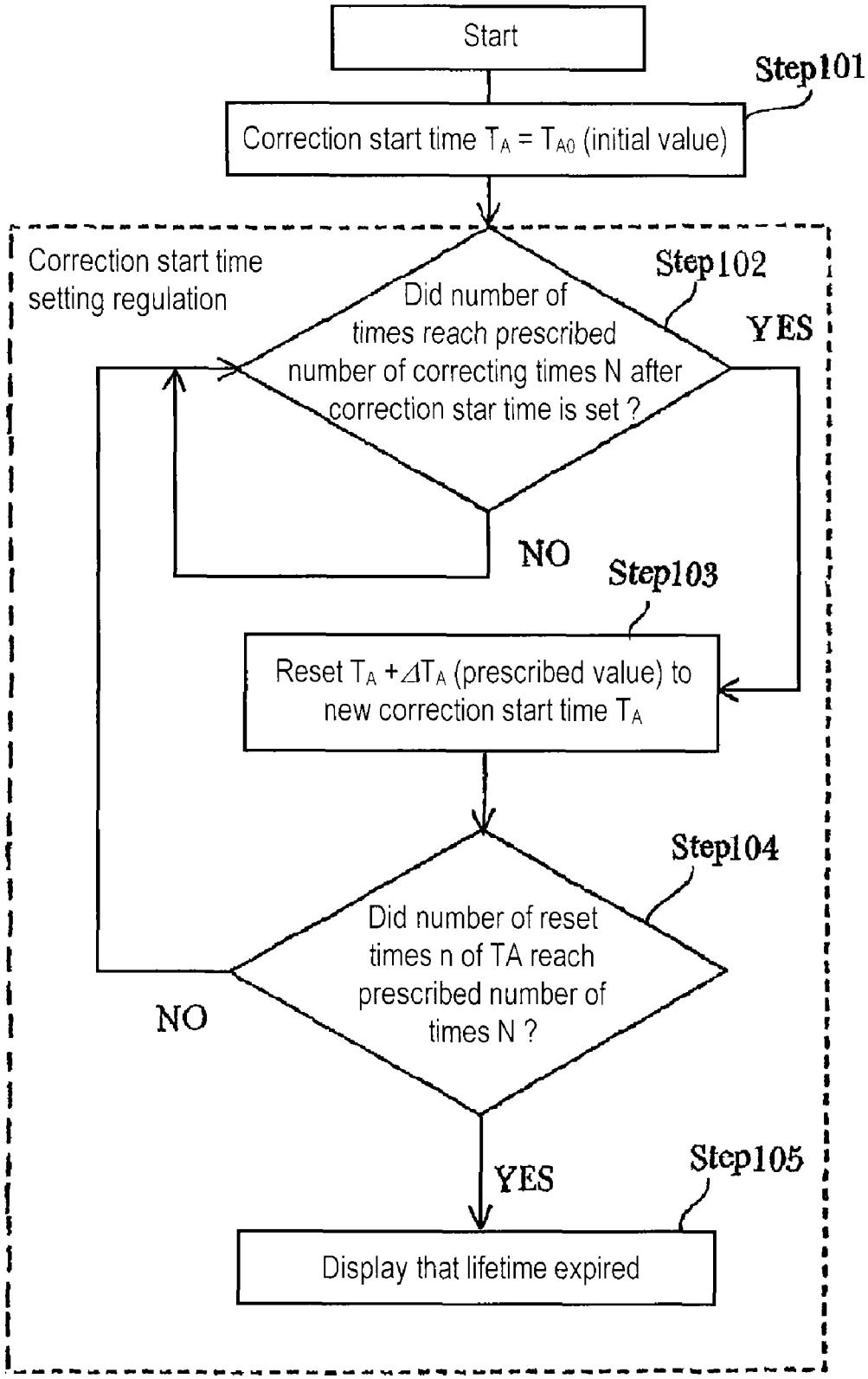
FIG. 14 is a flowchart of calculation regulation for obtaining correction start time TA.

The correction start time TA is determined by the following calculation regulation. FIG. 14 is a flowchart of the calculation regulation for obtaining the correction start time TA.

First, an initial value TA0 of the correction start time TA is set in the image forming apparatus (Step 101). Next, the CPU 123 stores, in a RAM 123*a*, number of times (number of times of the skew feeding correcting operations) of the skew feeding correcting operations after the correction start time TA is set (or reset). If the skew feeding correcting operation times reach number of times N which is previously stored in the ROM 123*b* (YES in Step 102), the CPU 123 resets time in which a previously set adjustment value ΔTA is added to the correction start time as new correction start time TA (Step 103). The CPU 123 counts number of reset times n of the correction start time TA by a counter 123*c*, and if the number of reset times are equal to or less than predetermined number of times N (NO in Step 102), subsequent procedures are repeated.

If the number of reset times n reaches the predetermined number of times N (YES in Step 104), the CPU 123 determines that the life time of the skew feeding correcting drive roller 21*a* expires, and information indicating that part must be exchanged is displayed on an operating portion 132 (FIG. 1) (Step 105).

Figure 15:
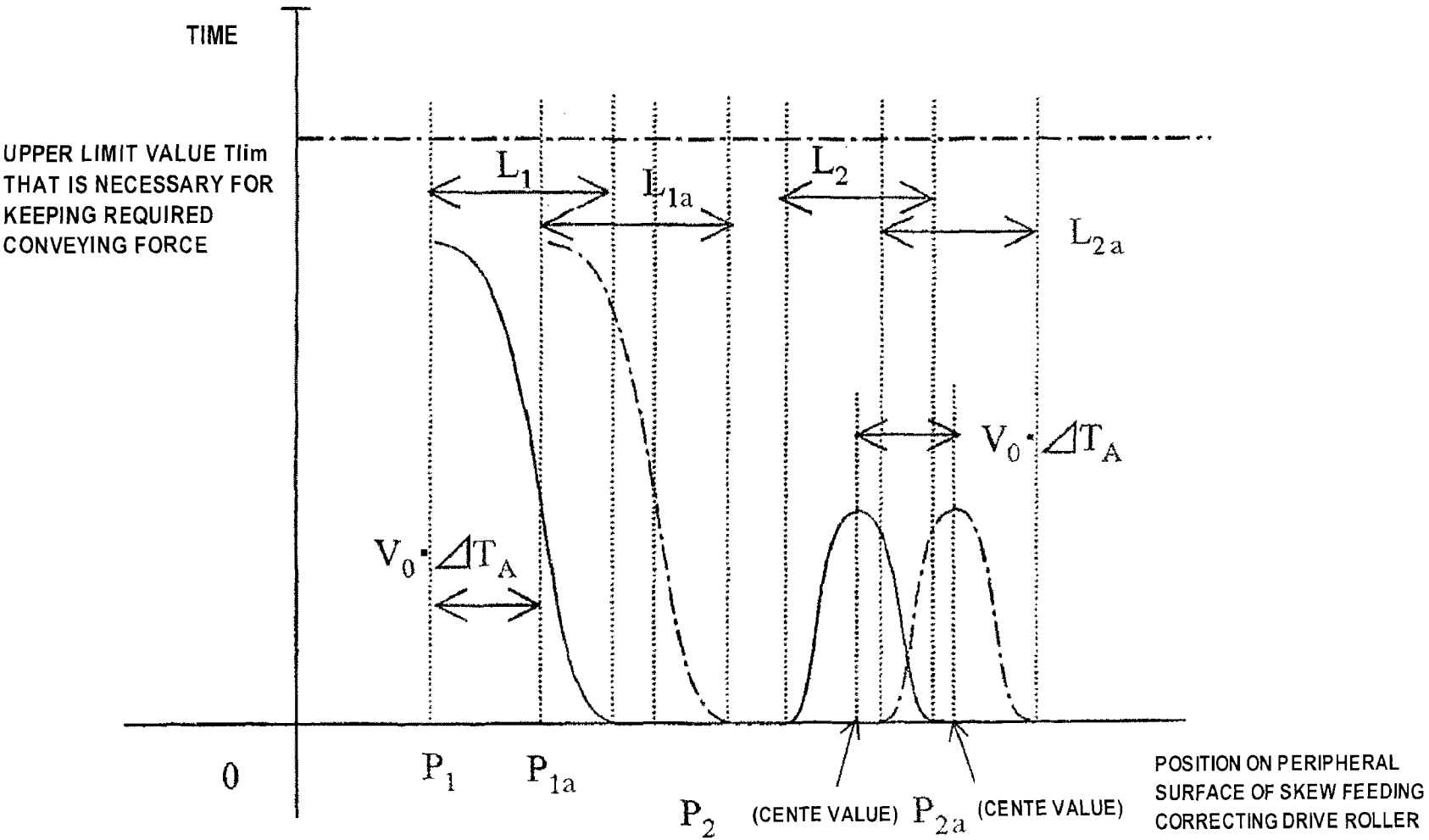
FIG. 15 is a graph illustrating a state where a region used for acceleration and deceleration of a sheet is dispersed on a peripheral surface of a skew feeding correcting drive roller by reset of the correction start time TA.

FIG. 15 is a graph illustrating a state where a region used for acceleration/deceleration of a sheet is dispersed on a peripheral surface of the skew feeding correcting drive roller 21*a* by resetting the correction start time TA. FIG. 13(*d*) is a schematic diagram of the skew feeding correcting drive roller 21*a* illustrating a state where the region is dispersed.

The skew feeding amount of a sheet to be corrected by the registration portion 1 (FIG. 2) is distributed with a width depending upon a set state of a sheet which is set in the cassette 100 (FIG. 1), a sheet conveying state of the pair of conveying rollers 105 (FIG. 1) and physical properties such as size and basis weight of a sheet. Therefore, a relation of a position on a peripheral surface of the skew feeding correcting drive roller 21*a* and cumulative time during which acceleration/deceleration of a sheet is carried out becomes one-side distribution dispersed around the first deceleration starting position P1, and two-side distribution dispersed around a center value of the first acceleration starting position P2 as illustrated in FIG. 15. If the correction start time is reset from AT to TA+ΔTA, the center of distribution of cumulative time during which acceleration/deceleration of a sheet is carried out is shifted from P1 illustrated in FIGS. 15 and 13(*d*) to P1*a*, and from P2 to P2*a*. A gap between P1 and P1*a*, and a gap between P2 and P2*a* are obtained by multiplying the conveying speed V0 by the adjustment value ΔTA. In this case, turning motion regions in the nip between the skew feeding correcting drive roller 21*a* and the skew feeding correcting follower roller 21*b* are L1*a* and L2*a*. As a result, the registration portion 1 prevents acceleration/deceleration of a sheet collectively at a specific position on the skew feeding correcting drive roller 21*a* from being continued.

Figure 16A:
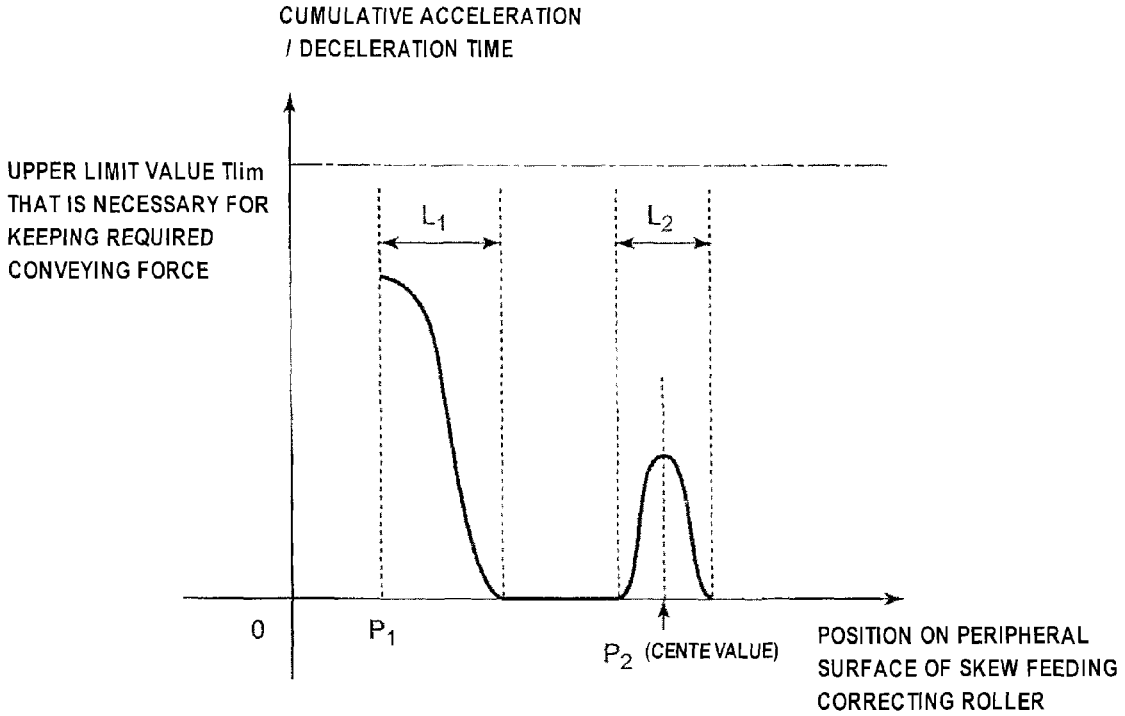
FIG. 16 is a graph illustrating accumulative time of acceleration of a sheet on the peripheral surface of the skew feeding correcting roller.
Figure 16B:
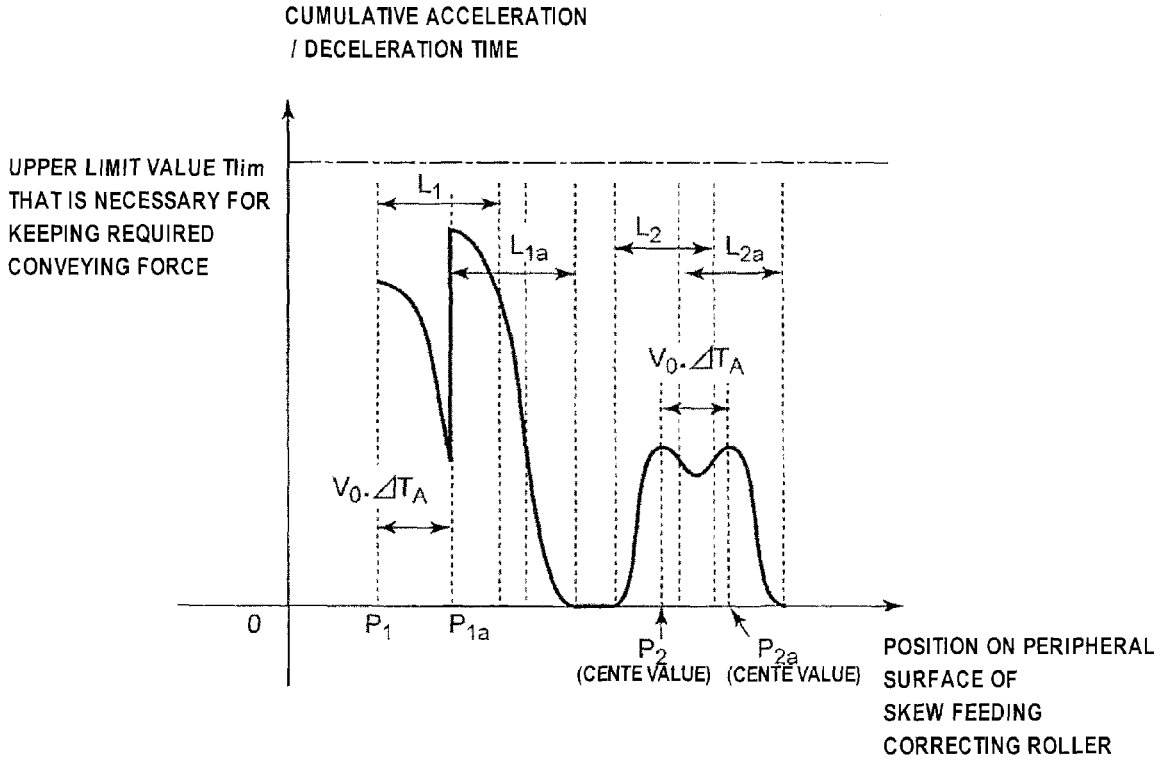

Values of the number of times n and N are determined in the following manner. That is, if the correction start time Ta is determined, a relation between the position on the skew feeding of the skew feeding correcting drive roller 21*a* and the cumulative time during which acceleration/deceleration of a sheet is carried out is distributed as illustrated in FIG. 15. When the correction start time TA is equal to the initial value TA0, distributions of the cumulative time when the correction start time TA is once reset and when the correction start time TA is reset twice are as illustrated in FIG. 16(*a*), FIG. 16(*b*) and FIG. 17.

As time during which acceleration/deceleration of a sheet is carried out is longer, the conveying force of the skew feeding correcting drive roller 21*a* is reduced. In order to keep the skew feeding correcting precision of a sheet at a constant level or higher, it is necessary that the sheet conveying force of the skew feeding correcting drive roller 21*a* also kept at a constant level or higher. Therefore, in order to obtain the precision of a desired skew feeding correcting operation, it is necessary that the cumulative time during which the skew feeding correcting drive roller 21*a* carries out acceleration/deceleration of a sheet is closer to the upper limit value Tlim. It is necessary that values of the number of times N and n are set such that when cumulative time during which acceleration/deceleration of a sheet is carried out is distributed, its maximum value does not exceed the upper limit value Tlim as illustrated in FIG. 16(*a*), FIG. 16(*b*) and FIG. 17.

At that time, if the adjustment value ΔTA is set small, a rate of cumulative time required before the correction start time TA is reset of cumulative time of acceleration/deceleration after the N-times skew feeding correcting operations at a center value P1*a* of a new distribution is increased. Thus, an inclination θ (FIG. 17) of a line connecting the maximum values of cumulative time becomes larger when the resetting operation of the correction start time TA is repeated. This speeds up the timing at which the maximum value of the cumulative time reaches the upper limit value Tlim, and the lifetime of the skew feeding correcting drive roller 21*a* is reduced.

Figure 17:
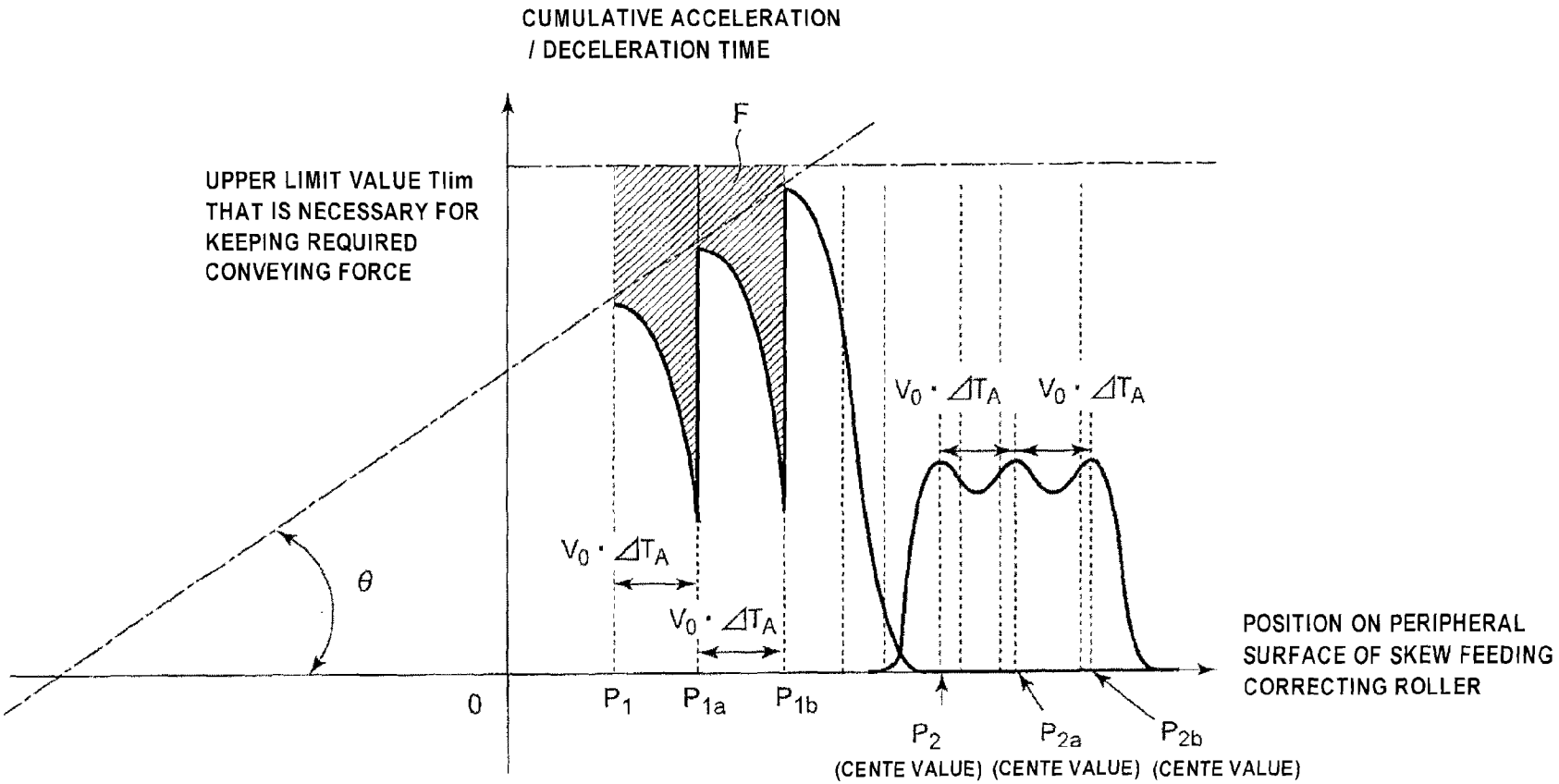
FIG. 17 is a graph illustrating accumulative time of acceleration of the sheet on the peripheral surface of the skew feeding correcting roller.

If the adjustment value ΔTA is set large, the inclination θ becomes small, but an area of a region such as a region F of hatch portion illustrated in FIG. 17 is increased. The region F in FIG. 17 shows that the cumulative time does not reach the upper limit value Tlim at each portion on the peripheral surface of the skew feeding correcting drive roller. Therefore, this shows that if the area of the region F is large, the peripheral surface of the skew feeding correcting drive roller 21*a* can not be used efficiently. That is, this shows that the lifetime of the skew feeding correcting drive roller 21*a* is shortened.

It is preferable that the number of times N, the number of times n and the adjustment value ΔTA are combinations in which the lifetime of the skew feeding correcting drive roller 21*a* becomes the longest in accordance with material of the skew feeding correcting drive roller 21*a*, the nip pressure of the pair of skew feeding correcting rollers 21 and a kind of mainly used sheet.

Since the deterioration of the skew feeding correcting precision caused by machining error of the pair of skew feeding correcting rollers 21 and 22 is reduced, phase control (for aligning the openings 21*c* and 22*c*) for aligning phases of the pair of skew feeding correcting rollers 21 and 22 is performed whenever the conveying operation of sheets is started.

It is necessary to pay attention so that reset of the correction start time TA does not influence the effect for reducing the deterioration of the skew feeding correcting precision by the machining error.

A reason thereof will be described. The acceleration/deceleration control of the pair of skew feeding correcting rollers 21 and 22 illustrated in FIG. 8 is carried out by controlling, by means of the CPU 123, the number of rotations (or rotation speed) of the skew feeding correcting motors 23 and 24 which rotate the pair of skew feeding correcting rollers 21 and 22. Thus, even if the starting timing of the acceleration/deceleration control is changed, if the change amount of the number of rotations and the acceleration/deceleration time of the skew feeding correcting motors 23 and 24 are constant, a difference in phases of the pair of skew feeding correcting rollers 21 and 22 after the acceleration/deceleration is completed is not changed. That is, even if a sheet is conveyed slightly in the meandering manner due to the machining error of the pair of skew feeding correcting rollers 21 and 22, if the phase control of the pair of skew feeding correcting roller is performed, even if the starting timing of the acceleration/deceleration control is changed, tracks on which sheets are conveyed in the meandering manner always match with each other after the acceleration/deceleration is completed. Therefore, variation in the skew feeding correcting precision is not influenced by the change of starting timing of the acceleration/deceleration control.

The correction start time TA has been described above, but if the reset of the correction start time is carried out also with respect to the correction start time TB, it can be prevented the conveying force from being deteriorated at a specific position of the skew feeding correcting drive roller 21*a* by the second skew feeding correcting operation.

Although the skew feeding of a sheet is corrected by the skew feeding correcting drive roller 21*a* in the above description, the skew feeding may be corrected by the skew feeding correcting drive roller 22*a*. The skew feeding may be corrected by both the skew feeding correcting drive rollers 21*a* and 22*a*.

Although the skew feeding is corrected by the skew feeding correcting drive roller 21*a* in the above description, if a sheet is not skew fed, the skew feeding correcting operation is not carried out, and the other skew feeding correcting follower roller 21*b* and the openings 21*c* and 22*c* rotate in unison. In this case, if a position where the pair of skew feeding correcting rollers 21 and 22 nip a tip end of a sheet is changed from the symbol P1 to P4 illustrated in FIG. 12 in accordance with the number of sheets to be conveyed, it is possible to prevent the deterioration of the conveying force from being concentrated on specific positions of the skew feeding correcting drive rollers 21*a* and 22*a*.

Although the skew feeding correcting operation of a sheet is carried out by the skew feeding correcting drive roller 21*a* in the above description, the skew feeding may be corrected by the skew feeding correcting drive roller 22*a*. The skew feeding may be corrected by both the skew feeding correcting drive rollers 21*a* and 22*a*.

The registration portion 1 changes the timing for changing the rotation speeds of the skew feeding correcting drive rollers 21*a* and 22*a* by the control of the controller 120 as described above. With this, the registration portion 1 prevents the conveying force from being concentrated on specific positions of the skew feeding correcting drive rollers 21*a* and 22*a*, local wearing and deterioration of the conveying force can be prevented, and the skew feeding correcting drive rollers 21*a* and 22*a* can be used for a long term.

The registration portion 1 includes the sheet detector which detects a sheet, actuation sensors 27*a* and 27*b* as skew feeding detectors, and the skew feeding correcting HP sensors 25 and 26 as rotation body detectors which detect rotation positions of the skew feeding correcting drive rollers 21*a* and 22*a* as bodies of rotation. In the registration portion 1, the controller 120 as the control portion changes the rotation speed of the skew feeding correcting drive roller based on the detecting operation of the actuation sensor, and changes the timing for changing the rotation speed based on the detecting operation of the skew feeding correcting HP sensor. With this, the registration portion 1 prevent the deterioration in conveying force from being concentrated on specific positions of the skew feeding correcting drive rollers 21*a* and 22*a* irrespective of whether the skew feeding correcting drive rollers 21*a* and 22*a* carry out the skew feeding correcting operations, and the skew feeding correcting drive rollers 21*a* and 22*a* can be used for a long term.

The registration portion 1 includes a counter 123*c* as a counting portion which counts the number of sheets to be conveyed by the skew feeding correcting drive rollers 21*a* and 22*a*. When a count value of the counter 123*c* becomes equal to a preset value, the controller 120 of the registration portion 1 changes the timing for changing the rotation speeds of the skew feeding correcting drive rollers 21*a* and 22*a*. With this, the registration portion 1 prevent the deterioration in conveying force from being concentrated on specific positions of the skew feeding correcting drive rollers 21*a* and 22*a* irrespective of whether the skew feeding correcting drive rollers 21*a* and 22*a* carry out the skew feeding correcting operations, and the skew feeding correcting drive rollers 21*a* and 22*a* can be used for a long term.

The registration portion 1 includes the skew feeding detection sensors 28*a* and 28*b* as skew feeding detectors which detect skew feeding of a sheet, and the two skew feeding correcting drive rollers 21*a* and 22*a* are disposed such that they can independently rotate in a direction intersecting with the sheet conveying direction. In the registration portion 1, the controller 120 individually changes the timing for changing the rotation speeds of the two skew feeding correcting drive rollers 21*a* and 22*a* based on the skew feeding of a sheet detected by the skew feeding detection sensors 28*a* and 28*b*. With this, the registration portion 1 avoids a case where the skew feeding correcting drive rollers 21*a* and 22*a* carry out the skew feeding correcting operation and deterioration in the conveying force is concentrated on the specific positions. With this, the skew feeding correcting drive rollers 21*a* and 22*a* can be used for a long term.

In the above-described registration portion 1, the number of times N in the skew feeding direction, the number of reset times n of the correction start time TA and the adjustment value ΔTA of the correction start time which are previously stored in the ROM 123*b* have predetermined values.

Figure 18:
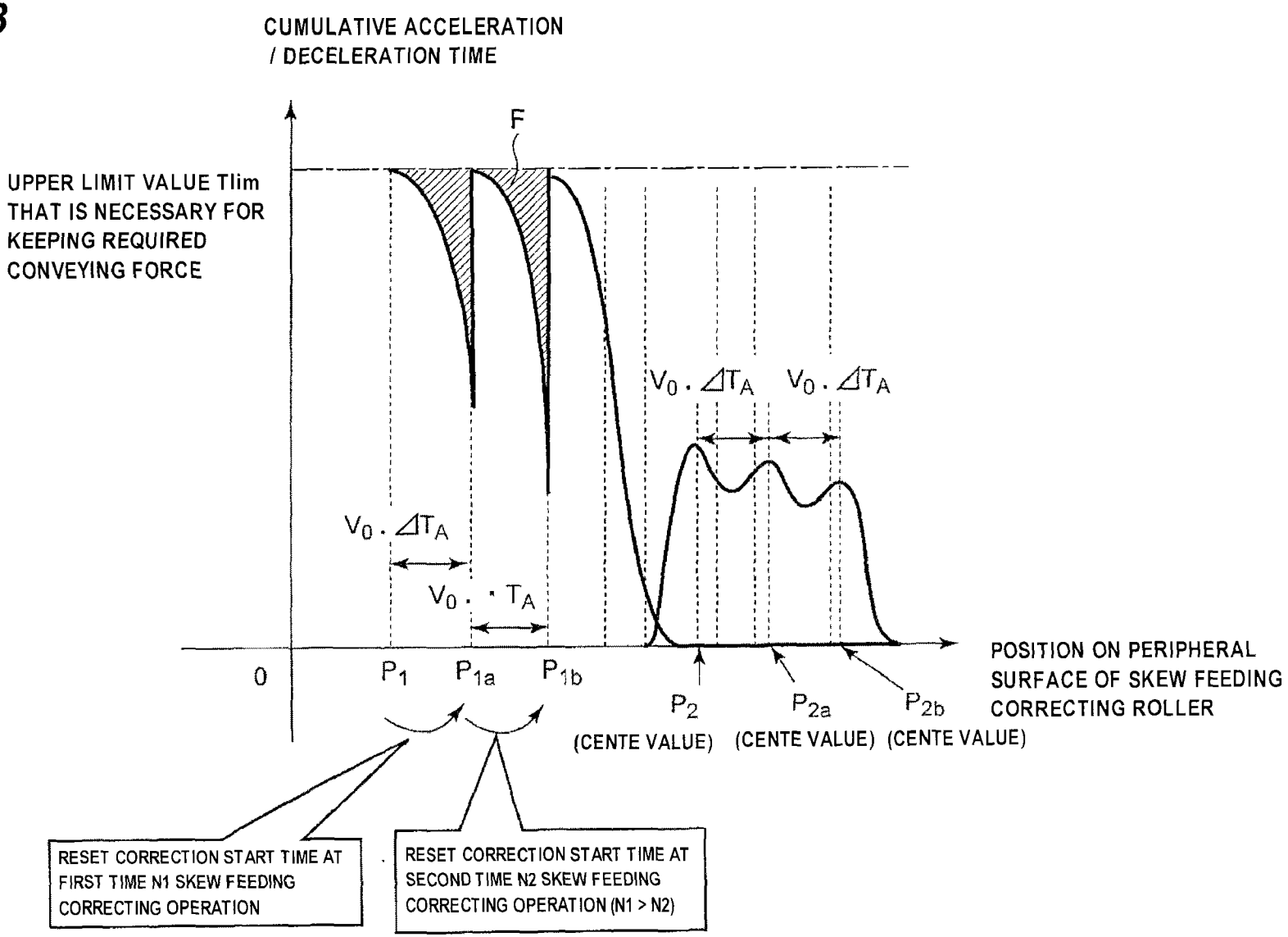
FIG. 18 is a graph illustrating accumulative time of acceleration and deceleration of the sheet on the peripheral surface of the skew feeding correcting roller.
Figure 19A:
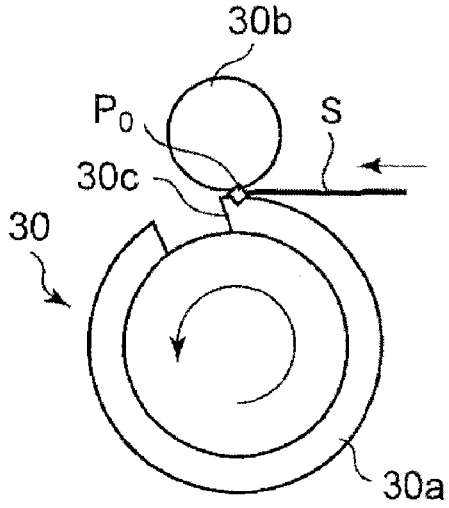
FIG. 19 is a diagram illustrating a rotation position (position of an opening) of a registration drive roller in each time illustrated in FIG. 11.
Figure 19C:
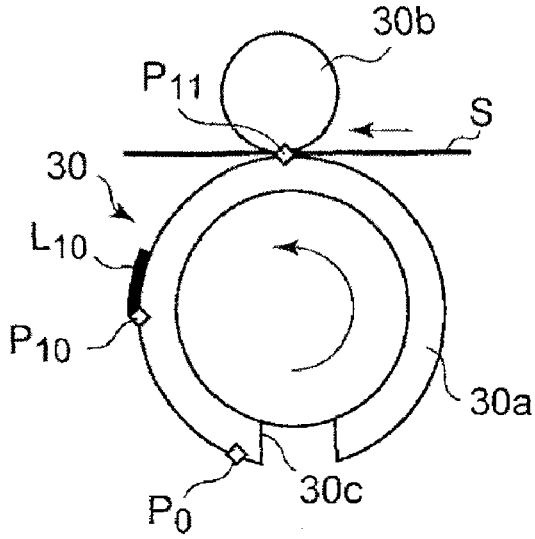
Figure 19B:
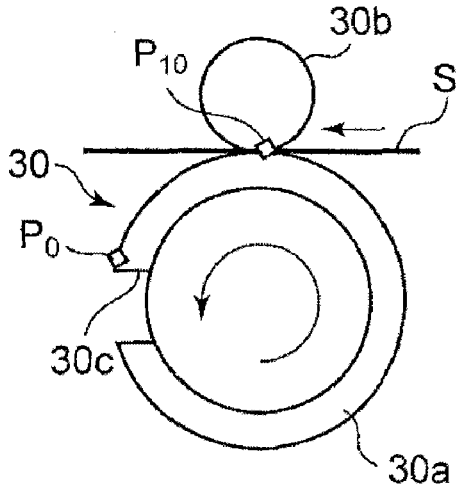
Figure 19D:
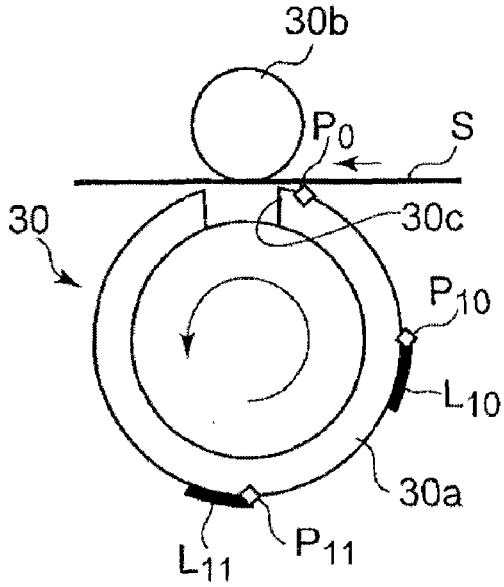

In the registration portion, a skew feeding amount of a sheet which is to be corrected is stored, the number of times N and n and the adjustment value ΔTA may be changed every time within ranges (upper limit ranges) which satisfy the constraint conditions in accordance with distribution shape of the skew feeding amount so that the correction start time can be reset. For example, when the conveying force of the skew feeding correcting drive roller 21*a* is in the initial state (state where the roller is not worn) in the entire region, the number of times N is large N1, and if the cumulative time at a position where cumulative time during which a sheet is accelerated or decelerated on the outer peripheral surface of the roller is the longest reaches the upper limit value, the correction start time is reset. Next, if the cumulative time at a position where cumulative time when a sheet is accelerated or decelerated is the longest reaches the upper limit value Tlim, the correction start time is again rest. At that time, since the cumulative acceleration/deceleration time accumulated before the last reset is carried out is added, the number of times N is set to small N2 which is smaller than N1. Similarly, after that, whenever the correction start time is reset, the number of times N is gradually reduced (FIG. 18).

In other words, the number of times N is always adjusted such that the inclination θ illustrated in FIG. 17 becomes 0. At that time, if the adjustment value ΔTA of the correction start time is reduced as small as possible, the area of the region F gets closer and closer to 0. Therefore, the outer peripheral surface of the roller can be utilized efficiently. However, if the value after the number of times N2 is not reduced extremely, the maximum value of the cumulative time of the acceleration/deceleration exceeds the upper limit value Tlim. For example, if the correction start time is reset whenever several or several tens of skew feeding correcting operations are carried out, this excessively complicates the control, and a burden on the control circuit is increased and thus, this is not preferable. Therefore, the adjustment value ΔTA of the correction start time is determined such that the correction start time is reset whenever a few thousand skew feeding correcting operations are carried out.

The history of the acceleration/deceleration time is held, and the adjustment value ΔTA of the correction start time may be determined whenever the correction start time is reset so that the center value of distribution of the new acceleration/deceleration time comes to a position where the cumulative value of the acceleration/deceleration time is the smallest. At that time, the adjustment value ΔTA is not limited to a positive value, and it may be a negative value.

A detector which detects the skew feeding amount of a sheet may be provided after the skew feeding correcting operation, and the correction start time may be reset when the skew feeding amount of a sheet after the skew feeding correcting operation becomes equal to or lower than a prescribed precision.

In the registration portion 1, the correction start time is reset for the skew feeding correcting roller portion 20 so that the skew feeding correcting drive roller 21*a* is not worn unevenly, but the pair of registration rollers 30 are not worn unevenly neither.

That is, in the registration portion 1, to align a sheet with a toner image of the photosensitive drum 112 by the pair of registration rollers 30, the roller acceleration/deceleration control timing when the tip registration or lateral registration is carried out is reset so as to prevent local wearing at specific position and deterioration of the conveying force.

FIG. 11 is a time chart for describing the skew feeding correcting operation of the pair of registration rollers. FIG. 18 is a graph illustrating cumulative time of acceleration/deceleration of a sheet on a peripheral surface of the skew feeding correcting roller. FIG. 19 is a diagram illustrating a rotation position (position of the opening 30*c*) of the registration drive roller 30*a* at each time illustrated in FIG. 11.

In FIG. 19, a symbol P10 shows a nip position on the peripheral surface of the registration drive roller 30*a* in the rotation direction when deceleration (acceleration) is started. A symbol P11 shows a nip position when acceleration (deceleration) is started. A symbol L10 shows a region where a sheet is decelerated (accelerated) from the P10 as a starting point. A symbol L11 shows a region where a sheet is accelerated (decelerated) from the P11 as a starting point.

Figure 20:
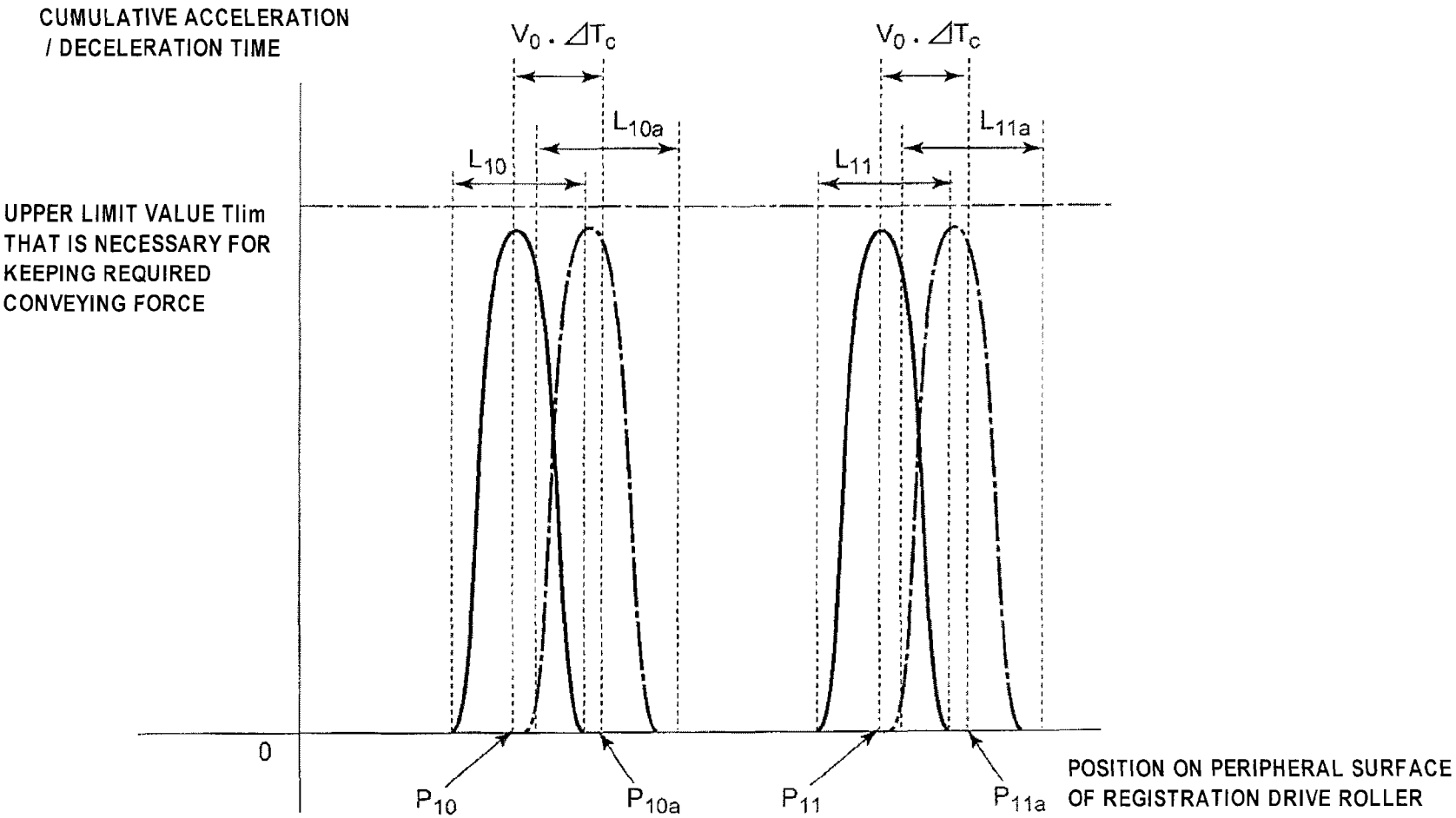
FIG. 20 is a graph illustrating accumulative time of acceleration and deceleration of the sheet on the peripheral surface of the registration drive roller.

Therefore, the CPU 123 resets time from the instant when the registration sensor 131 detects a tip end of a sheet to the instant when the acceleration/deceleration control is started by adding the adjustment value ΔTC to the correction start time TC. With this, the peripheral surface of the registration drive roller 30*a* can be used for acceleration/deceleration for evenly. In FIG. 20, symbols P10*a* and P11*a* show nip positions on the peripheral surface of the registration drive roller 30*a* in the rotation direction when the reset is carried out and deceleration (acceleration) is started. A distance between P10 and P10*a*, and a distance between P11 and P11*a* are obtained by multiplying the conveying speed V0 by the adjustment value ΔTC. The symbol L10*a* shows a region where a sheet is decelerated (accelerated) from P10*a* as a start point. The symbol L11*a* shows a region where a sheet is accelerated (decelerated) from P11*a* as a start point.

As described above, the registration portion 1 changes the timing for changing the rotation speed of the registration drive roller 30*a* by control of the controller 120. With this, the registration portion 1 can prevent a conveying force from being concentrated on a specific position of the registration drive roller 30*a*, prevent local wearing and deterioration of a conveying force, and the registration drive roller 30*a* can be used for a long term.

The registration portion 1 includes the registration sensor 131 as a sheet detector which detects a sheet, and the registration HP sensor 32 as a rotation body detector which detects a rotation position of the registration drive roller 30*a* as a rotation body. In the registration portion 1, the controller 120 changes the rotation speed of the registration drive roller based on the detection operation of the registration sensor, and changes the timing at which the rotation speed is changed based on the detection operation of the registration HP sensor 32. The registration portion 1 prevents the deterioration of a conveying force from being concentrated on a specific position of the registration drive roller 30*a*, and prevents local wearing and deterioration of the conveying force, and the registration drive roller 30*a* can be used for a long term.

Figure 21A:
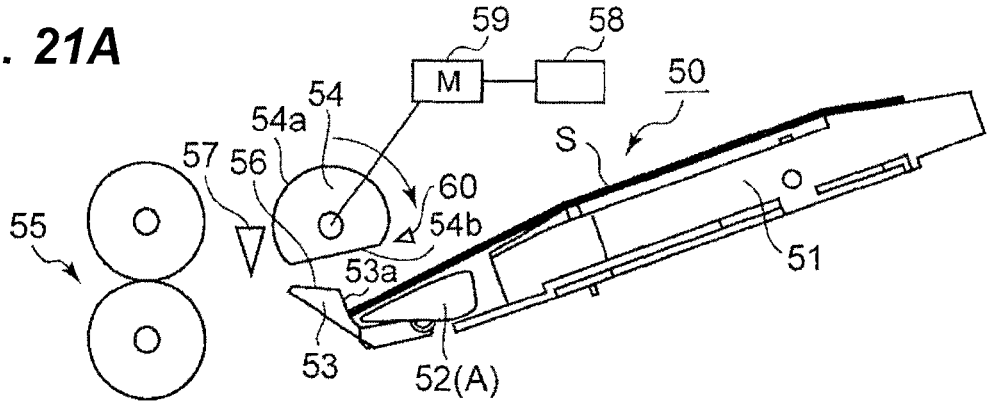
FIG. 21 is a sectional view of a sheet feeding device in an image forming apparatus as an image processing apparatus according to a second embodiment taken along the sheet conveying direction.
Figure 21B:
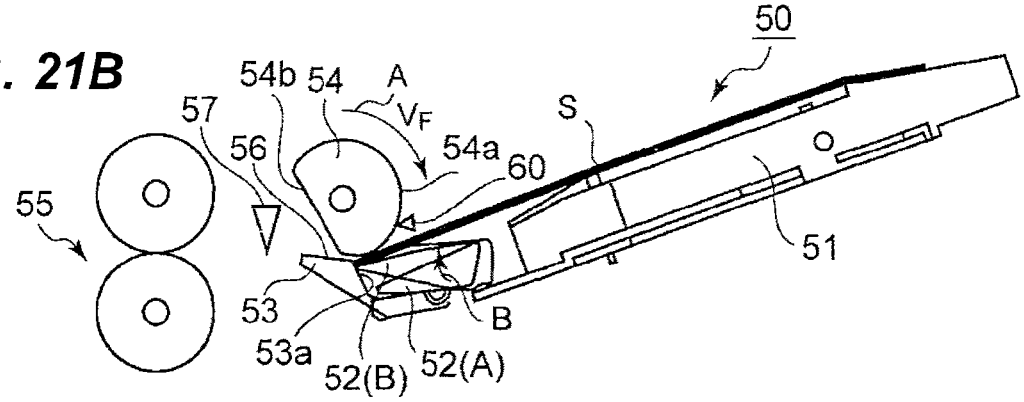
Figure 21C:
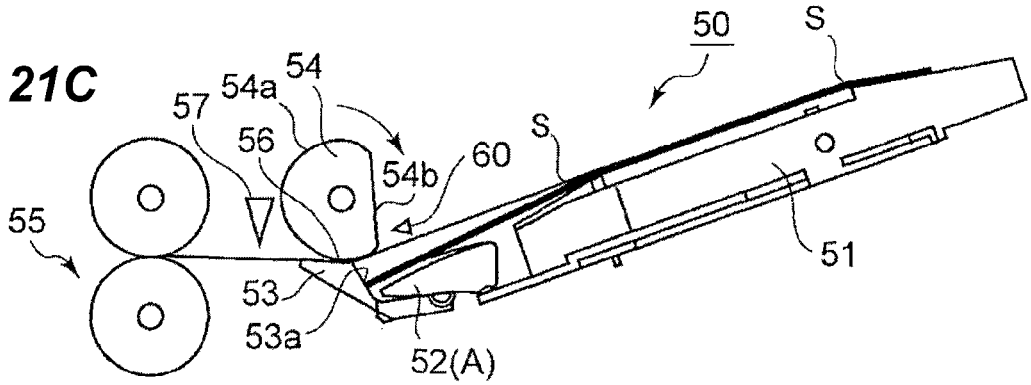
Figure 22:
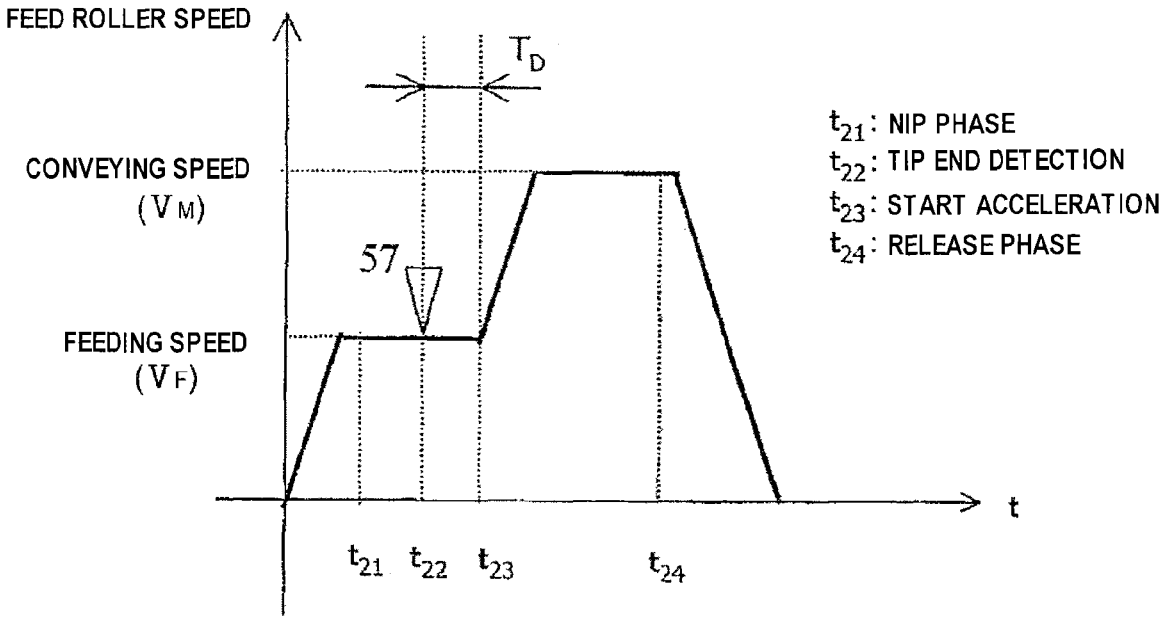
FIG. 22 is a graph illustrating variation in a sheet conveying speed of the sheet feeding device, wherein a lateral axis illustrates time and a vertical axis illustrates the sheet conveying speed.
Figure 23:
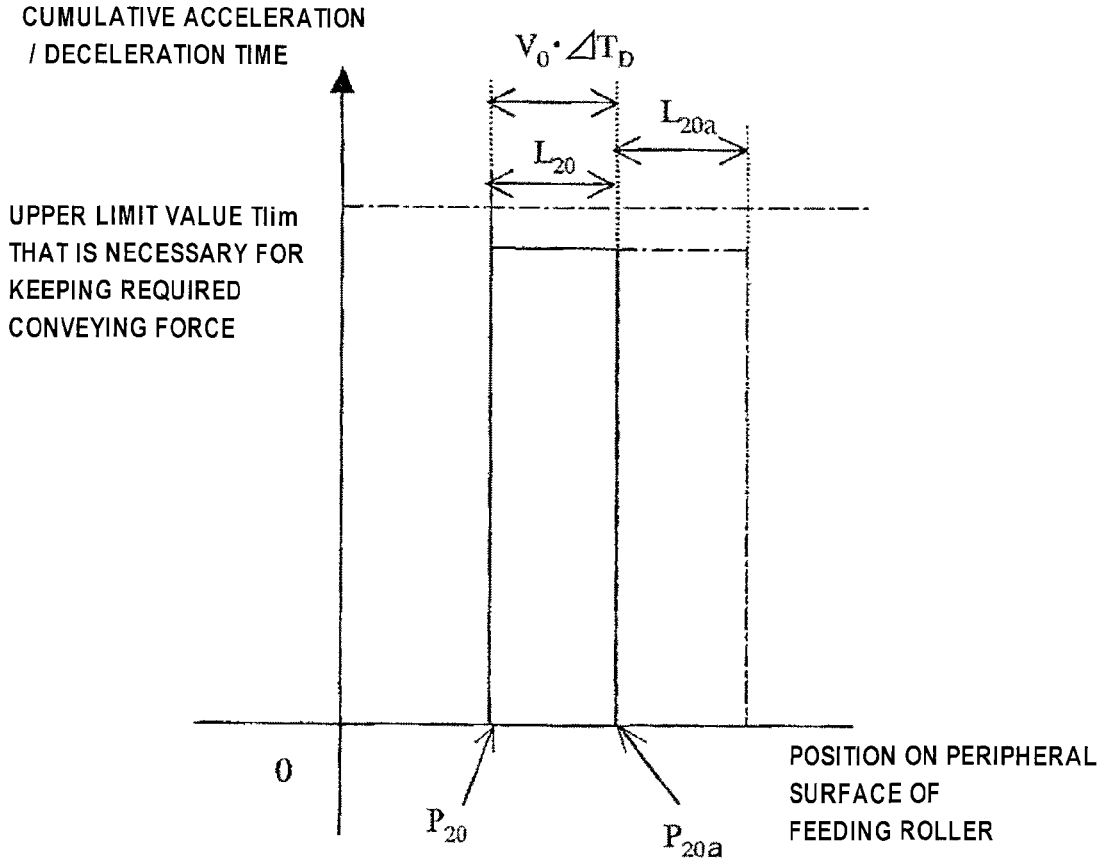
FIG. 23 is a graph illustrating a state where a region used for acceleration and deceleration of a sheet is dispersed on a peripheral surface of a feeding roller by reset of the correction start time in the sheet feeding device.
Figure 24:
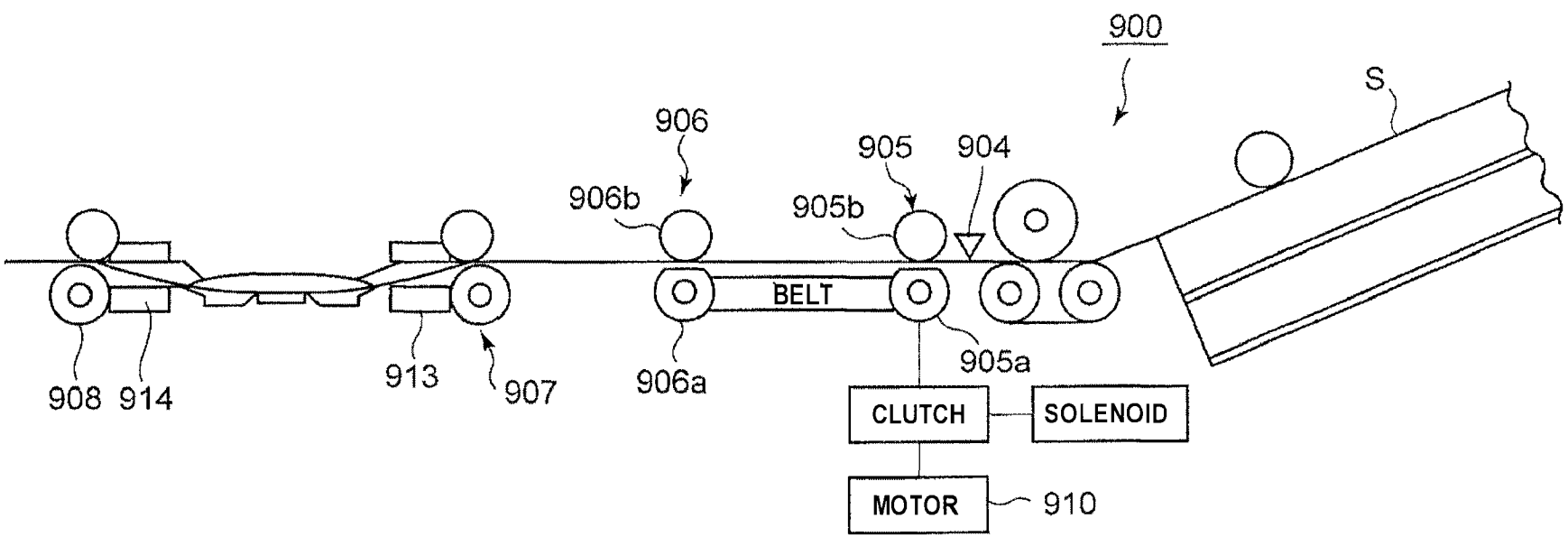
FIG. 24 PRIOR ART
FIG. 24 is a schematic diagram of a conventional sheet conveying apparatus.

Sheet Feeding Device in Image Forming Apparatus as Image Processing Apparatus of a Second Embodiment FIG. 21 is a sectional view of a sheet feeding device taken along the sheet conveying direction. FIG. 22 is a graph illustrating variation in conveying speed of a sheet, wherein a lateral axis shows time and a vertical axis shows a sheet conveying speed. FIG. 23 is a graph illustrating a state where a region used for acceleration/deceleration of a sheet on an outer peripheral surface of the feeding roller 54 by reset of correction start time is dispersed.

A structure of the sheet feeding device 50 which is the sheet conveying apparatus will be described. The sheet feeding device 50 is a so-called sheet conveying apparatus which is provided in the image forming apparatus forming an image on a sheet and which feeds a sheet. Illustration and description of a portion which forms an image on a sheet will be omitted. The sheet feeding device 50 is also a so-called original conveying apparatus which feeds originals.

The sheet feeding device 50 includes a tray 51 as a sheet storage portion in which sheets S are stored, and a feeding flapper 52 which lifts a tip end of a sheet S to change a surface height of the sheet. The sheet feeding device 50 also includes a feeding roller 54 which receives the sheet S lifted by the feeding flapper 52 by a conveying surface 54*a* which is the greatest outer diameter portion, and which feeds the sheet S. The sheet feeding device 50 also includes a separation pad 56 which is disposed opposed to the feeding roller 54 as a rotation body and which abuts against the conveying surface 54*a* of the feeding roller 54 to form a feeding nip. The sheet feeding device 50 also includes a pad support stage 53 which holds the separation pad 56 and applies a conveying pressure.

The feeding roller 54 is formed into half-moon shape in a phase ("released phase", hereinafter) where a notch 54*b* having a small outer diameter and a separation pad 56 are opposed to each other, the feeding roller 54 does not form a nip between the feeding roller 54 and the separation pad 56 so that a conveying force is not applied to a sheet. The notch 54*b* of the feeding roller 54 stops at a position detected by a notch detection sensor 60, and the notch 54 is rotated by a drive motor 59 whose rotation is controlled by a control portion 58 as a control portion with respect to this position.

The sheet feeding device 50 includes a pair of conveying rollers 55 which conveys a sheet S fed by the feeding roller 54. The pair of conveying rollers 55 are provided downstream of the feeding roller 54. The sheet feeding device 50 also includes a tip end detection sensor 57 which is disposed on the control portion between the feeding roller 54 and the pair of conveying rollers 55 and which detects a tip end of a sheet S.

The operation of the sheet feeding device will be described.

When the sheet feeding device 50 does not feed a sheet, the sheet feeding roller 54 is on standby on the release phase (FIG. 21(*a*)). At the same time, the feeding flapper 52 is on standby at a position illustrated with a symbol 52(A) in FIG. 21(*a*), a front end of a sheet S butts against a front end restriction surface 53*a* formed on the pad support stage 53 to align the sheet. If the feeding roller 54 is rotated to start feeding a sheet, the feeding flapper 52 is turned from a position illustrated with a symbol 52(A) to a position illustrated with a symbol 52(B). The top sheet is lifted to a position where the sheet abuts against the conveying surface 54*a* of the feeding roller 54 (FIG. 21(*b*)).

The feeding roller 54 rotates from the release phase at a feeding speed VF in the direction of the arrow A, and the conveying surface 54*a* abuts against an upper surface of the sheet S at a phase illustrated in FIG. 21(*b*) ("nip phase", hereinafter). Instantaneously, a conveying force is transmitted to a sheet S, and the sheet feeding device 50 starts feeding the sheet (t21 in FIG. 22). The sheet S whose feeding operation was started by the feeding roller 54 reaches a feeding nip formed by the feeding roller 54 and the separation pad 56. When a plurality of sheets S are conveyed at the same time (multi-feeding), a friction force is generated between the bottom sheet and the separation pad 56, and the conveying operation of the bottom sheet is restrained. Thus, only the top sheet S is fed. When the feeding operation of only one sheet S is started, since a friction force between the sheet S and the feeding roller 54 is greater than a friction force between the sheet S and the separation pad 56, the conveying operation of sheet S is not hindered by the separation pad 56.

Tip ends of sheets S which are separated and fed in this manner are then detected by the tip end detection sensor 57 (t22 in FIG. 22). Acceleration of the feeding roller 54 is started up to the conveying speed VM during rotation when acceleration start time TD is elapsed after the tip end is detected (FIG. 21(*c*) and t23 in FIG. 22).

When sheets are fed, since the feeding roller 54 accelerates sheets from the stationary state to the feeding speed VF, an inertial resistance of sheets S is generated in the feeding roller 54. That is, the sheet S cannot immediately start moving. Thus, a slip is generated between the feeding roller 54 and the sheet S, and the feeding precision of the sheet feeding device 50 is deteriorated. To reduce the slip, the feeding speed should be reduced, but the number of sheets to be fed per unit time is reduced on the contrary, and the productivity of the sheet feeding device 50 is deteriorated.

To solve this problem, a sheet S is reliably nipped at low feeding speed VF to feed the sheet when the feeding operation is started (FIG. 21(*b*)) and then, if the tip end detection sensor 57 detects the tip end of the sheet, the sheet feeding device accelerates up to the conveying speed VM (FIG. 21(*c*)), thereby preventing the productivity from being deteriorated.

A position where the acceleration of a sheet is started on the peripheral surface of the feeding roller 54 is defined as P20 and a region where acceleration of a sheet is carried out downstream of P20 is defined as L20, a relation between the position on the peripheral surface of the feeding roller 54 and cumulative time during which the acceleration of a sheet is carried out is as illustrated in FIG. 23. In the sheet feeding device 50 also, ΔTD is added to the acceleration start time TD and reset is carried out, thereby dispersing the cumulative time. A position where the acceleration of a sheet is started at the time of reset is P20*a*, and a region where the acceleration of a sheet is carried out downstream of P20*a* is L20*a*. The positions P20 and P20*a* where the acceleration of a sheet is started are set by the control portion 58 with reference to time when the notch detection sensor 60 detects the notch 54*b*. A distance between P20 and P20*a* is obtained by multiplying a conveying speed V0 by the adjustment value ΔTD.

As described above, the sheet feeding device 50 changes the timing at which the rotation speed of the feeding roller 54 is changed by control of the control portion 58. With this, the sheet feeding device 50 prevents a conveying force from being concentrated on a specific position of the feeding roller 54, the sheet feeding device 50 prevents local wear and deterioration of the conveying force, and the feeding roller 54 can be used for a long term.

The sheet feeding device 50 includes a tip end detection sensor 57 as a sheet detector which detects a sheet, and a notch detection sensor 60 as a rotation body detector which detects a rotation position of the feeding roller 54 as a rotation body. The sheet feeding device 50 changes timing at which the control portion 58 changes a rotation speed of the feeding roller 54 based on the detection operation of the tip end detection sensor 57 and the control portion 58 changes a rotation speed based on the detection operation of the notch detection sensor 60. With this, the sheet feeding device 50 prevents a conveying force from being concentrated on a specific position of the feeding roller 54, the sheet feeding device 50 prevents local wear and deterioration of the conveying force, and the feeding roller 54 can be used for a long term.

In each of the embodiments, phases of the skew feeding correction roller and the feeding roller 54 when acceleration/deceleration control of a sheet is carried out using the correction start time TA are estimated, but a phase detector such as a rotary encoder may detect a rotation speed of the roller and the acceleration/deceleration may be controlled. Thus, the rotation body detector is not limited to the skew feeding correcting HP sensors 25 and 26, the registration HP sensor 32 or the notch detection sensor 60, and may includes a rotary encoder.

Since the image forming apparatus 3000 includes the registration portion 1 capable of increasing the lifetime of the skew feeding correcting drive rollers 21*a* and 22*a*, the number of times of the exchanging operations of roller is reduced, and the operation efficiency can be enhanced.

The registration portion 1 and the sheet feeding device 50 can also be provided in the automatic original feeding apparatus 250. In this case, since the scanner 2000 as the image processing apparatus and the image reading apparatus have the automatic original feeding apparatus 250 having a small number of times of exchanging operations of roller, the number of times of reading operations by the scanning light source 201 can be increased, and the operation efficiency can be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-191597, filed Jul. 24, 2007, which is hereby incorporated by reference herein in its entirety.

What is claimed is:

1. An image processing apparatus comprising an image processing portion which processes an image on a sheet;

a rotation body which conveys a sheet toward the image processing portion; and a control portion which starts rotation of the rotation body from the same position of the rotation body in a circumferential direction and which changes a rotation speed during rotation of the rotation body; wherein the control portion can change a starting position of the rotation body in a circumferential direction at which the rotation speed of the rotation body is changed;

the image processing apparatus further comprising:

a count portion which counts the number of sheets conveyed by the rotation body; wherein the control portion changes the starting position, at which the rotation body changes speed, in a circumferential direction in response to a value counted by the count portion becoming equal to a preset count value.

2. The image processing apparatus according to claim 1, wherein the control portion sets the starting position of the rotation body at which the rotation speed of the rotation body is changed, by means of time required until the speed is changed after the rotation of the rotation body is started.

3. The image processing apparatus according to claim 1, further comprising a sheet detector which detects a conveyed sheet; and a rotation body detector which detects a position of the rotation body in the circumferential direction to stop the rotation body at the same position; wherein the control portion stops the rotation body at the same position in the circumferential direction based on the detection of the rotation body detector, the control portion start rotating the rotation body based on the detection of the sheet detector, and the control portion changes the starting position in a circumferential direction at which the rotation speed is changed.

4. The image processing apparatus according to claim 1, further comprising a skew feeding detector which detects skew feeding of a sheet, wherein a plurality of rotation bodies are disposed in a direction intersecting with a sheet conveying direction such that the rotation bodies can individually rotate, and the control portion accelerates or decelerates the rotation speed of the plurality of rotation bodies based on the skew feeding of the sheet detected by the skew feeding detector to correct the skew feeding of the sheet, and the control portion individually corrects the starting position at which the rotation speed of the plurality of rotation bodies are accelerated or decelerated.

5. The image processing apparatus according to claim 1, further comprising a sheet storage portion in which a sheet is stored; wherein the rotation body is a feeding roller which conveys a sheet stored in the sheet storage portion, and the control portion can change the starting position of the rotation body at which the rotation speed of the feeding roller is accelerated or decelerated.

6. The image processing apparatus according to claim 1, wherein the image processing portion is an image forming portion which forms an image on a sheet.

* * * * *